US008564514B2

(12) United States Patent
Yoshihara et al.

(10) Patent No.: US 8,564,514 B2
(45) Date of Patent: Oct. 22, 2013

(54) DRIVING METHOD OF LIQUID CRYSTAL DISPLAY DEVICE AND LIQUID CRYSTAL DISPLAY DEVICE

(75) Inventors: Toshiaki Yoshihara, Kawasaki (JP); Shinji Tadaki, Kawasaki (JP); Tetsuya Makino, Kawasaki (JP); Hironori Shiroto, Kawasaki (JP); Yoshinori Kiyota, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 343 days.

(21) Appl. No.: 10/282,679

(22) Filed: Oct. 29, 2002

(65) Prior Publication Data

US 2003/0043103 A1 Mar. 6, 2003

Related U.S. Application Data

(63) Continuation-in-part of application No. 09/946,265, filed on Sep. 5, 2001, now Pat. No. 7,081,873.

(30) Foreign Application Priority Data

Apr. 18, 2001 (JP) ..... 2001-120211
Feb. 18, 2002 (JP) ..... 2002-040677

(51) Int. Cl.
*G09G 3/36* (2006.01)

(52) U.S. Cl.
USPC ..... 345/87; 345/76; 345/77; 345/94

(58) Field of Classification Search
USPC ..... 345/87–90, 96, 97, 102, 103
See application file for complete search history.

(56) References Cited

U.S. PATENT DOCUMENTS

| | | | | |
|---|---|---|---|---|
| 5,092,665 | A | 3/1992 | Kanbe et al. | 359/56 |
| 5,363,225 | A * | 11/1994 | Minamihara et al. | 345/96 |
| 5,867,135 | A * | 2/1999 | Salavin et al. | 345/68 |
| 5,990,859 | A * | 11/1999 | Inoue et al. | 345/103 |
| 5,999,154 | A * | 12/1999 | Yoshioka | 345/89 |
| 6,232,935 | B1 * | 5/2001 | Fukushima et al. | 345/67 |
| 6,373,451 | B1 * | 4/2002 | Kang et al. | 345/60 |
| 6,396,469 | B1 * | 5/2002 | Miwa et al. | 345/87 |
| 6,473,077 | B1 * | 10/2002 | Takenaka et al. | 345/209 |
| 6,486,864 | B1 | 11/2002 | Nakajima et al. | 345/92 |
| 6,646,625 | B1 * | 11/2003 | Shigeta et al. | 345/63 |

(Continued)

FOREIGN PATENT DOCUMENTS

| | | |
|---|---|---|
| JP | 63-301926 | 12/1988 |
| JP | 4-218023 | 8/1992 |

(Continued)

*Primary Examiner* — Sumati Lefkowitz
*Assistant Examiner* — Jesus Hernandez
(74) *Attorney, Agent, or Firm* — Greer, Burns & Crain, Ltd.

(57) ABSTRACT

In a liquid crystal display device that uses a liquid crystal material having spontaneous polarization and is actively driven by a TFT, a voltage corresponding to image data is applied twice by driving the TFT of each pixel electrode on a line by line basis of a liquid crystal panel, during writing in one frame. During erasure in one frame, voltage application to liquid crystal by batch selection of all the pixel electrodes is performed three times. With this three times of voltage application, it is possible to achieve a black display state in each pixel and make the stored charge amount at the liquid crystal in each pixel substantially zero.

9 Claims, 24 Drawing Sheets

(56) References Cited

U.S. PATENT DOCUMENTS

| | | | | |
|---|---|---|---|---|
| 6,703,990 | B2 * | 3/2004 | Tokunaga et al. | 345/60 |
| 6,836,265 | B1 * | 12/2004 | Lee et al. | 345/87 |
| 2001/0045933 | A1 * | 11/2001 | Sakaigawa et al. | 345/98 |
| 2002/0047584 | A1 * | 4/2002 | Rutherford | 315/169.4 |
| 2003/0107538 | A1 * | 6/2003 | Asao et al. | 345/87 |

FOREIGN PATENT DOCUMENTS

| | | | | |
|---|---|---|---|---|
| JP | 06-059642 | * | 3/1994 | G09G 3/20 |
| JP | 6-175101 | | 6/1994 | |
| JP | 7-64055 | | 3/1995 | |
| JP | 10-62811 | | 3/1998 | |
| JP | 10-62817 | | 3/1998 | |
| JP | 10-239662 | | 9/1998 | |
| JP | 11-52327 | | 2/1999 | |
| JP | 11-119189 | | 4/1999 | |
| JP | 2000-19485 | | 1/2000 | |
| JP | 2000-28984 | | 1/2000 | |
| JP | 2000-28985 | | 1/2000 | |
| JP | 2000-147454 | | 5/2000 | |
| JP | 2000-180825 | | 6/2000 | |
| JP | 2000-180827 | | 6/2000 | |
| JP | 2000-267070 | | 9/2000 | |
| JP | 2000-284254 | | 10/2000 | |
| JP | 2000-330092 | | 11/2000 | |
| JP | 2000-330519 | | 11/2000 | |
| JP | 2001-51253 | | 2/2001 | |
| JP | 2001-91922 | | 4/2001 | |
| JP | 2001-215471 | | 8/2001 | |
| JP | 2002-23137 | | 1/2002 | |

* cited by examiner

DRIVING METHOD OF LIQUID CRYSTAL DISPLAY DEVICE AND LIQUID CRYSTAL DISPLAY DEVICE

This is a continuation-in-part of U.S. patent application Ser. No. 09/946,265, filed Sep. 5, 2001, now U.S. Pat. No. 7,081,873 issued Jul. 25, 2006.

BACKGROUND OF THE INVENTION

The present invention relates to a driving method of a liquid crystal display device using a liquid crystal material having spontaneous polarization and also relates to a liquid crystal display device adopting the driving method.

Along with the recent development of so-called information-oriented society, electronic apparatuses, such as personal computers and PDA (Personal Digital Assistants), have been widely used. Further, with the spread of such electronic apparatuses, portable apparatuses that can be used in offices as well as outdoors have been used, and there are demands for small-size and light-weight of these apparatuses. Liquid crystal display devices have been widely used as one of the means to satisfy such demands. Liquid crystal display devices not only achieve small size and light weight, but also include an indispensable technique in an attempt to achieve low power consumption in portable electronic apparatuses that are driven by batteries.

The liquid crystal display devices are mainly classified into the reflection type and the transmission type. In the reflection type liquid crystal display devices, light rays incident from the front face of a liquid crystal panel are reflected by the rear face of the liquid crystal panel, and an image is visualized by the reflected light; whereas in the transmission type liquid crystal display devices, the image is visualized by the transmitted light from a light source (back-light) provided on the rear face of the liquid crystal panel. Since the reflection type liquid crystal display devices have poor visibility resulting from the reflected light amount that varies depending on environmental conditions, the transmission type liquid crystal display devices are generally used as display devices of, particularly, personal computers displaying a multi-color or full-color image.

In addition, the current color liquid crystal display devices are generally classified into the STN (Super Twisted Nematic) type and the TFT-TN (Thin Film Transistor-Twisted Nematic) type, based on the liquid crystal materials to be used. The STN type liquid crystal display devices have comparatively low production costs, but they are not suitable for the display of a moving image because they are susceptible to crosstalk and comparatively slow in the response rate. In contrast, the TFT-TN type liquid crystal display devices have better display quality than the STN type, but they require a back-light with high intensity because the light transmittance of the liquid crystal panel is only 4% or so at present. For this reason, in the TFT-TN type liquid crystal display devices, a lot of power is consumed by the back-light, and there would be a problem when used with a portable battery power source. Moreover, the TFT-TN type liquid crystal display devices have other problems including a low response rate, particularly, in displaying half tones, a narrow viewing angle, and a difficult color balance adjustment.

Therefore, in order to solve the above problems, the present inventors et al. are carrying out the development of a liquid crystal display device using a ferroelectric liquid crystal having spontaneous polarization and a high response rate of several hundreds to several μs order with respect to an applied voltage. When a liquid crystal material having spontaneous polarization is used as the liquid crystal material, the liquid crystal molecules are always parallel to the substrate irrespective of the presence or absence of applied voltage, and the change in the refraction factor in the viewing direction is much smaller compared with the conventional STN type and TN type. It is thus possible to obtain a wide viewing angle. Moreover, in a liquid crystal display device in which a ferroelectric liquid crystal that is superior in the response characteristics and the viewing angle to the conventional liquid crystal materials is driven by a switching element such as a TFT, it is possible to achieve a light transmittance corresponding to the magnitude of the applied voltage and display a half-tone image and a moving image.

This ferroelectric liquid crystal has the applied voltage-light transmittance characteristics as shown in FIG. 1. More specifically, the light transmittance of the ferroelectric liquid crystal varies depending on the polarity, and, for example, when a positive voltage is applied, the light transmittance is increased according to the applied voltage, while when a negative voltage is applied, the light transmittance becomes substantially zero irrespective of the magnitude of the applied voltage. Accordingly, in the conventional example, display is controlled by a drive sequence as shown in FIG. 2.

In one frame for forming a display image, selective scanning is performed twice for the pixel electrodes of each line, and voltages of equal magnitude and opposite polarities are alternately applied to the liquid crystal material at a predetermined cycle and for a predetermined period. The magnitude of the applied voltage corresponds to the image data, and a display image is obtained (writing is performed) by applying a voltage corresponding to the image data at the beginning of each frame, and then the display image is erased (erasure is performed) by applying a voltage having different polarity and the same magnitude as the above voltage. By repeating such writing and erasure in each frame, the display of image is realized. Besides, writing and erasure realizes display without variations in the screen brightness and prevents variations in the charge so as to eliminate image sticking of display.

In this driving method, as shown in FIG. 1, when the applied voltage has the negative polarity, the transmittance is substantially 0%, and thus black display is implemented. Therefore, the time contributing to actual display is a half of the total time, and there is a problem that the light utilization efficiency given by the ratio of the screen brightness to the light source brightness is low (the screen brightness/back-light brightness percentage is 6% in the conventional example adopting the drive sequence shown in FIG. 2).

Furthermore, since the ferroelectric liquid crystal has spontaneous polarization, it is necessary to store charges twice more than the spontaneous polarization in each pixel electrode for selective scanning of each pixel electrode, and thus there is a problem that a liquid crystal material having large spontaneous polarization can not be used in view of the facts that the capacity of each pixel electrode and the drive voltage are not so high.

Besides, when the incorporation of the liquid crystal display device into a portable apparatus is taken into consideration, it is preferred to drive the liquid crystal display device by a low voltage, but there is a problem that driving by a sufficiently low voltage has not yet been realized (the drive voltage is 12 V in the conventional example using a ferroelectric liquid crystal having spontaneous polarization of 11 $nC/cm^2$).

BRIEF SUMMARY OF THE INVENTION

An object of the present invention is to provide a driving method of a liquid crystal display device and a liquid crystal display device, capable of improving the light utilization efficiency.

Another object of the present invention is to provide a driving method of a liquid crystal display device and a liquid crystal display device, capable of using a liquid crystal material having large spontaneous polarization and achieving a further reduction in the response time.

Still another object of the present invention is to provide a driving method of a liquid crystal display device and a liquid crystal display device, capable of reducing the drive voltage.

In the driving method of liquid crystal display device according to the present invention, with respect to the liquid crystal display device comprising the common electrode, pixel electrodes, liquid crystal material having spontaneous polarization sealed between the common electrode and pixel electrodes and switching elements for switching the liquid crystal material corresponding to each pixel electrode, the voltage application to the liquid crystal material by batch selection of a part or all of the pixel electrodes is performed at least twice during the erasure of image data. By performing such a voltage application by the batch selection a plurality of times, it is possible to achieve a black display state in each pixel and make the stored charge amount at the liquid crystal material in each pixel substantially zero. More specifically in the case where the voltage application is performed twice, black display of each pixel is realized by the first voltage application, and the stored charge amount at the liquid crystal material in each pixel is made substantially zero by the second voltage application.

With a prior art, it is necessary to charge the liquid crystal material from a negative voltage value to a positive voltage value, for example, and therefore it takes at most twice a time for charging, resulting in a longer selection period of one line. Moreover, in the prior art, a time equivalent to a half of the entire time is taken to scan the pixel electrodes corresponding to the image data to be displayed and balance the stored charge amount at the liquid crystal material in each pixel electrode by positive application and negative application.

Whereas, in the present invention, since the voltage application to the liquid crystal material by batch selection of a part or all of the pixel electrodes is performed at least twice so as to make the stored charge amount at liquid crystal material in each pixel electrode substantially zero, the time taken for balancing the charges biased to the liquid crystal material can be significantly shortened compared to the conventional example. Moreover, since the time taken for applying a voltage corresponding to the image data to be displayed to the liquid crystal material by selective scanning of line can also be shortened significantly compared to the prior art because the charge amount charged to the liquid crystal material becomes a half of a conventional amount. The reason for this is that, during the application of the voltage corresponding to the image data to be displayed to the liquid crystal material, the stored charge amount at the liquid crystal material immediately before the application is fixed at substantially zero, and therefore it is only necessary to charge from zero to zero or a voltage value of one polarity (+ or – polarity) corresponding to the image data to be displayed. Accordingly, since the time taken for balancing the stored charge amount at liquid crystal material in each pixel and the time taken for scanning the pixel electrodes corresponding to the image data to be displayed are significantly shortened, it is possible to increase the time contributing to actual display and improve the light utilization efficiency.

Moreover, the period of the above-mentioned batch selection is set longer than a time necessary for a response of the liquid crystal material. Accordingly, it is possible to secure a liquid crystal response in each pixel.

A liquid crystal display device of the present invention that implements the above-described driving method comprises a light source for emitting white color light and color filters of a plurality of colors, and provides color display by selectively transmitting the white color light from the light source by using the color filters of a plurality of colors.

A liquid crystal display device of the present invention that implements the above-described driving method comprises a light source for emitting light of a plurality of different colors, and provides color display by a field-sequential system without using color filters, by performing time-division switching of the colors of light emitted by the light source in synchronism with on/off driving of switching elements.

The above and further objects and features of the invention will more fully be apparent from the following detailed description with accompanying drawings.

DETAILED DESCRIPTION OF THE INVENTION

The following description will specifically explain the present invention with reference to the drawings illustrating some embodiments thereof. It should be noted that the present invention is not limited to the following embodiments.

Figure 3:
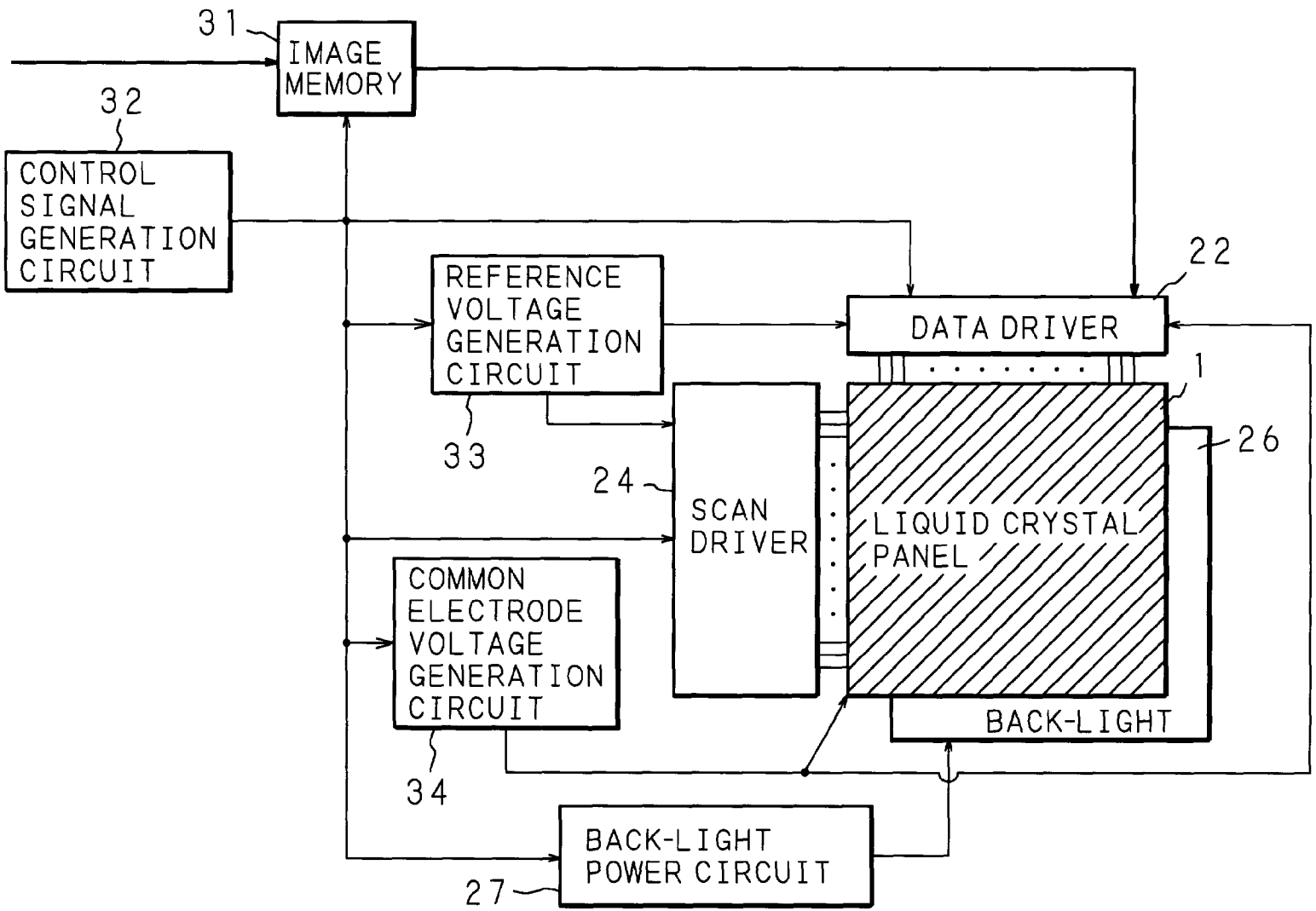
FIG. 3 is a block diagram of the entire structure of a liquid crystal display device of the present invention.
Figure 4:
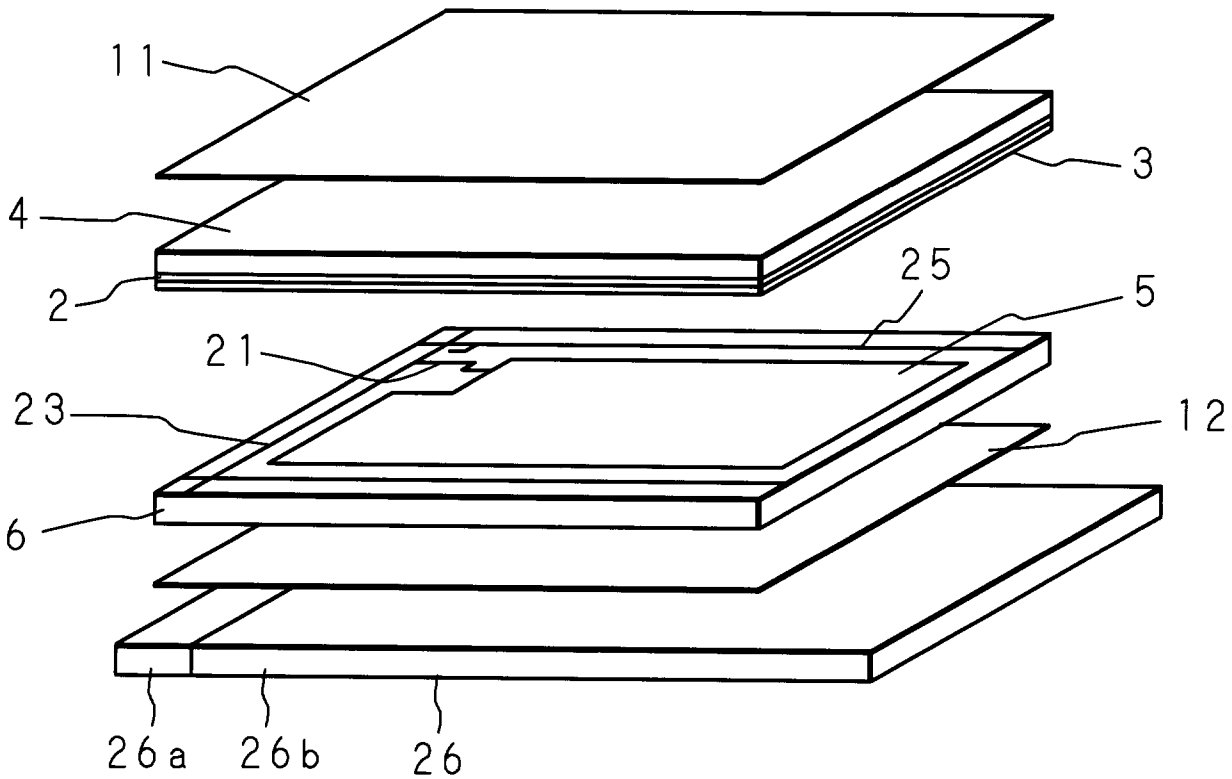
FIG. 4 is a schematic perspective view showing a structural example of a liquid crystal panel and back-light.
Figure 5:
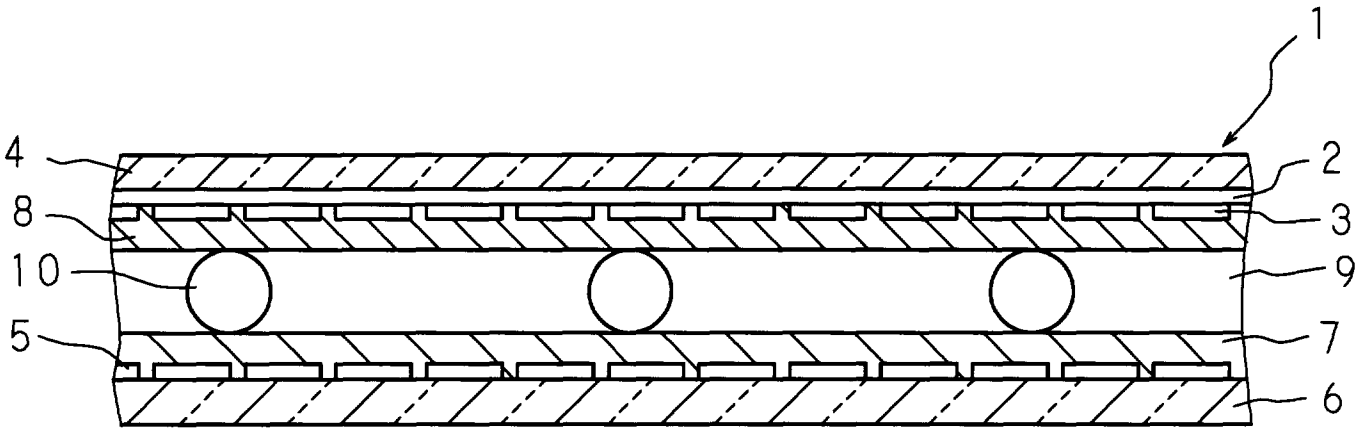
FIG. 5 is a schematic cross sectional view of the liquid crystal panel.

FIG. 3 is a block diagram of the entire structure of a liquid crystal display device of the present invention, FIG. 4 is a schematic perspective view showing a structural example of a liquid crystal panel and back-light, and FIG. 5 is a schematic cross sectional view of the liquid crystal panel.

As shown in FIG. 5, a liquid crystal panel 1 is constituted by a glass substrate 4 having a common electrode 2 and an RGB color filter/black matrix 3 arranged in a matrix form and a glass substrate 6 having pixel electrodes 5 arranged in a matrix form and TFTs 21 connected to the respective pixel electrodes 5 (see FIG. 4), which are stacked in this order from the upper layer (surface) side to the lower layer (rear face) side; alignment films 7 and 8 are arranged on the upper face of the pixel electrodes 5 on the glass substrate 6 and the lower face of the RGB color filter/black matrix 3, respectively; and a liquid crystal layer 9 is formed by filling the space between these alignment films 7 and 8 with a liquid crystal material as a ferroelectric liquid crystal. Note that numeral 10 represents spacers for maintaining the layer thickness of the liquid crystal layer 9. As shown in FIG. 4, this liquid crystal panel 1 is sandwiched by two pieces of polarization films 11 and 12, and further a back-light 26 is disposed under the liquid crystal panel 1.

The individual pixel electrodes 5 are selectively driven by on/off control of the TFTs 21, and the individual TFTs 21 are selectively turned on/off by inputting drive signals through a data driver 22 to a signal line 23 and inputting scan signals sequentially supplied on a line by line basis from a scan driver 24 to a scanning line 25. The intensity of transmitted light of the individual pixel is controlled by a voltage supplied through the TFT 21. The back-light 26 which comprises a light source 26*a* emitting white light and a light-guiding and light-diffusion plate 26*b*, is disposed on the lower layer (rear face) side of the liquid crystal panel 1 and driven by a back-light power circuit 27.

An image memory 31 receives an input of display data to be displayed on the liquid crystal panel 1 from an external device, for example, a personal computer. A control signal generation circuit 32 generates a synchronous control signal for synchronizing various processing, and outputs the generated synchronous control signal to the image memory 31, the data driver 22, the scan driver 24, a reference voltage generation circuit 33, a common electrode voltage generation circuit 34 and the back-light power circuit 27.

After temporarily storing the display data, the image memory 31 sends the display data to the data driver 22 in synchronism with the synchronous control signal. The reference voltage generation circuit 33 generates reference voltages for use in the data driver 22 and the scan driver 24, respectively, and outputs the reference voltages to the respective drivers. The common electrode voltage generation circuit 34 generates a common electrode voltage (Vcom), and applies it to the common electrode 2 and also outputs it to the data driver 22.

During writing, the data driver 22 outputs a signal to a signal lines 23 of the pixel electrodes 5, based on the image data outputted from the image memory 31. The scan driver 24 scans sequentially the scanning lines 25 of the pixel electrodes 5 on a line by line basis. According to the output of the signal from the data driver 22 and the scanning of the scan driver 24, the TFTs 21 are driven and the voltage is applied to the pixel electrodes 5, thereby controlling the intensity of the transmitted light of the liquid crystal layer 9 corresponding to the pixel electrodes 5.

On the other hand, during erasure, all of the pixel electrodes 5 are simultaneously selected (batch selection), and application of voltage is performed at least twice. In this case, during the first voltage application, a voltage that is substantially equal to or larger than the maximum value of a voltage corresponding to the image data and has different polarity is applied to the liquid crystal to achieve a black display state in all of the pixel electrodes 5. Moreover, in this case, during the last voltage application, a voltage nearly equal to the common electrode voltage (Vcom) is applied to make the stored charge amount at the liquid crystal in all the pixel electrodes 5 substantially zero.

Next, specific embodiments of the present invention will be explained. Note that the first through fourth embodiments described below are examples which are designed to select all the pixel electrodes simultaneously a plurality of times (preferably two or three times) during the erasure of data and apply a voltage to the liquid crystal in each of the selection periods, and thereby make it possible to perform voltage application to the liquid crystal by simultaneous selection of all the pixel electrodes a plurality of times (two or three times). In this case, a time necessary for a sufficient response of the liquid crystal is set between adjacent voltage applications.

Moreover, the fifth and eighth embodiments are examples which are designed to select all the pixel electrodes simultaneously once during the erasure of data and apply a voltage to the liquid crystal a plurality of times (preferably twice) in the selection period, and thereby make it possible to perform voltage application to the liquid crystal by simultaneous selection of all the pixel electrodes a plurality of times (twice). In this case, the selection period is set longer than a time necessary for a sufficient response of the liquid crystal.

First Embodiment

First, the liquid crystal panel 1 shown in FIGS. 4 and 5 was fabricated as follows. After washing a TFT substrate having the pixel electrodes 5 (800×600 pixels with a diagonal length of 12.1 inches) and a common electrode substrate having the common electrode 2 and the RGB color filter/black matrix 3, they were coated with polyimide and then baked for one hour at 200° C. to form the alignment films 7 and 8 made of about 200 Å thick polyimide films.

Further, these alignment films 7 and 8 were rubbed with a cloth made of rayon, and stacked with a gap being maintained therebetween by the spacers 10 made of silica having an average particle size of 1.6 μm so as to fabricate an empty panel. A ferroelectric liquid crystal material composed mainly of naphthalene-based liquid crystals (for example, a material disclosed by A. Mochizuki, et. al.: Ferroelectrics, 133,353 (1991)) was sealed in this empty panel to form the liquid crystal layer 9. The magnitude of spontaneous polarization of the sealed ferroelectric liquid crystal material was 6 nC/cm$^2$.

The fabricated panel was sandwiched by two polarizing films 11 and 12 maintained in a crossed-Nicol state so that a dark state was produced when the long-axis direction of the ferroelectric liquid crystal molecules of the liquid crystal layer 9 titled to one direction, thereby forming the liquid crystal panel 1. This liquid crystal panel 1 and the back-light 26 were stacked to construct a liquid crystal display device.

Figure 6:
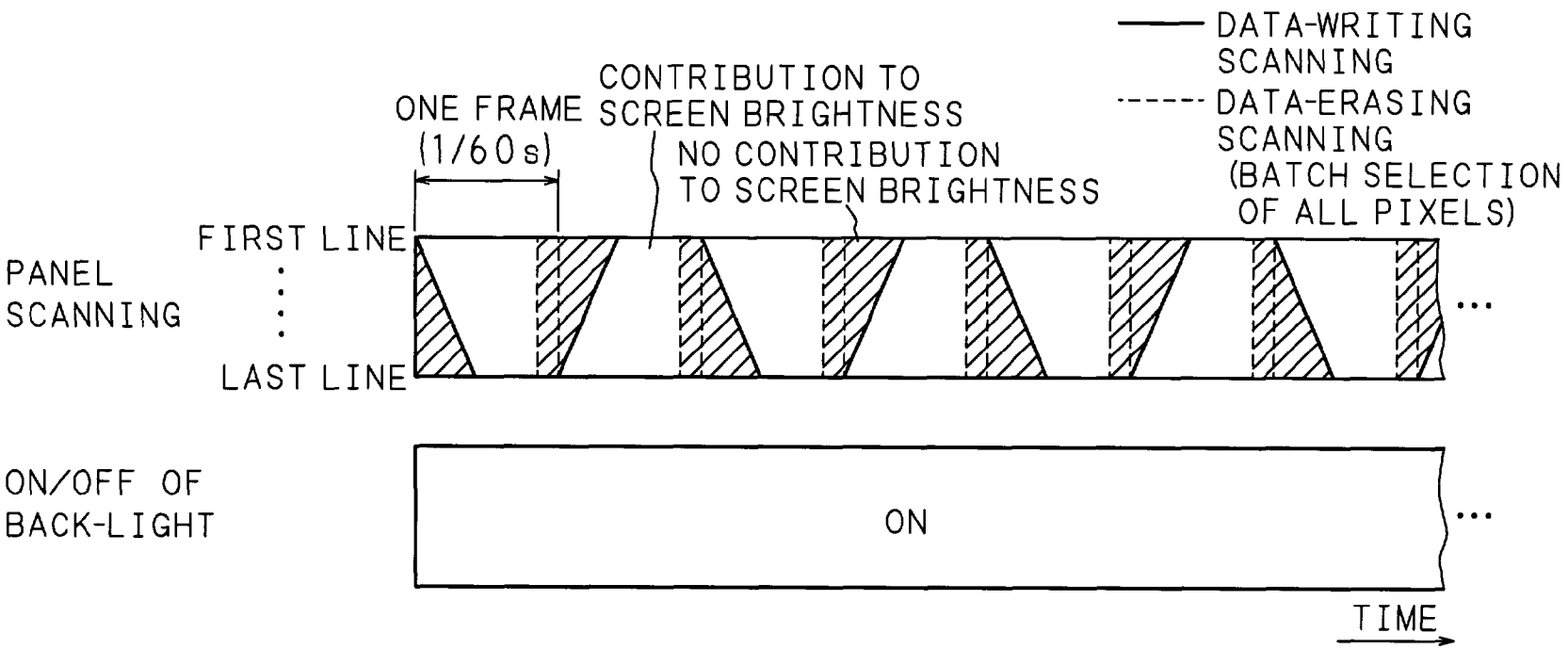
FIG. 6 is an illustration showing a drive sequence according to the first embodiment of the present invention.
Figure 8:
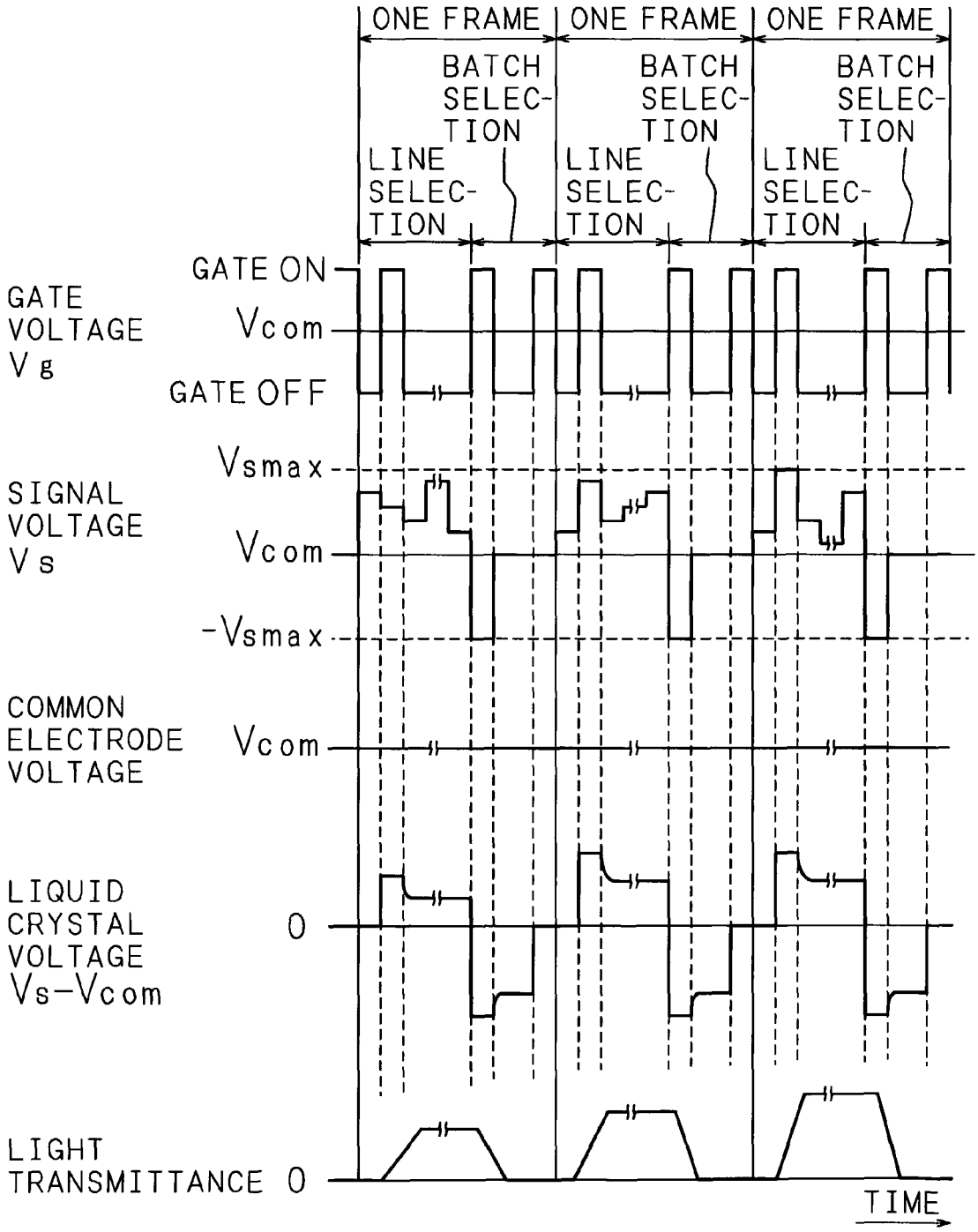
FIG. 8 is an illustration showing a drive sequence according to the first and second embodiments of the present invention.

Next, according to the drive sequences shown in FIGS. 6 and 8, the TFTs 21 of the respective pixel electrodes 5 were driven on a line by line basis to apply a voltage corresponding to the image data. The selection period of each line was 7 μs, and the time necessary for the entire writing was (7×n) μs (n is the number of lines). According to the conventional drive sequence shown in FIG. 2, since the selection period of each line was 13 μs, the speed was increased compared to the conventional example. Note that the order of scanning lines was reversed between adjacent frames so as to prevent variations in the screen brightness. The data-erasing scanning was performed twice.

The maximum applied voltage to the liquid crystal corresponding to the image data was made (the applied voltage to the common electrode 2 (Vcom)+7) V, the first applied voltage to the liquid crystal by batch selection of all the pixel electrodes (batch selection of all the lines) during erasure was made (Vcom−7) V, and the second applied voltage was made equal to Vcom. Moreover, a time interval of 500 μs in which the liquid crystal can respond sufficiently was set between the first voltage application and the second voltage application. The time of one frame was made 1/60 s, and the above-described writing of the image data and two times of voltage application to the liquid crystal by batch selection of all the pixel electrodes (erasure) were designed to be completed within each frame. The back-light 26 was always turned on.

Figure 1:
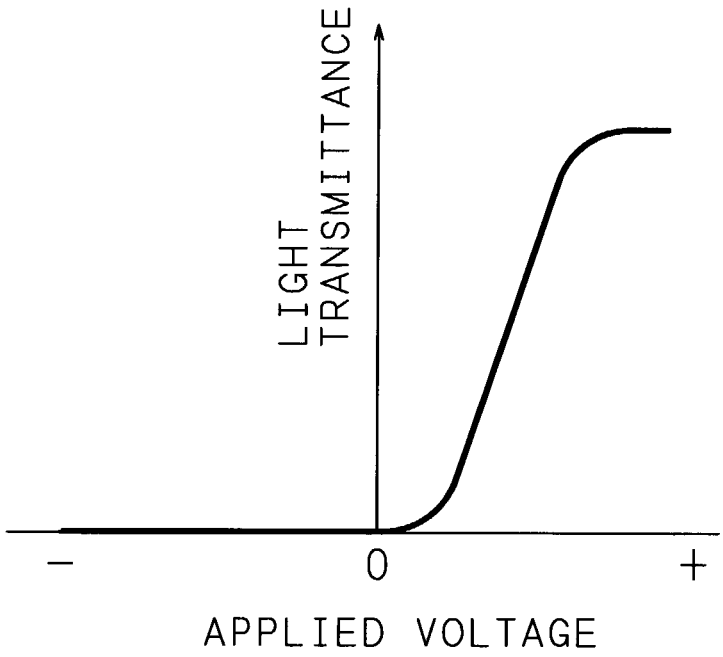
FIG. 1 PRIOR ART
FIG. 1 is a graph showing the applied voltage-light transmittance characteristics of a ferroelectric liquid crystal.
Figure 2:
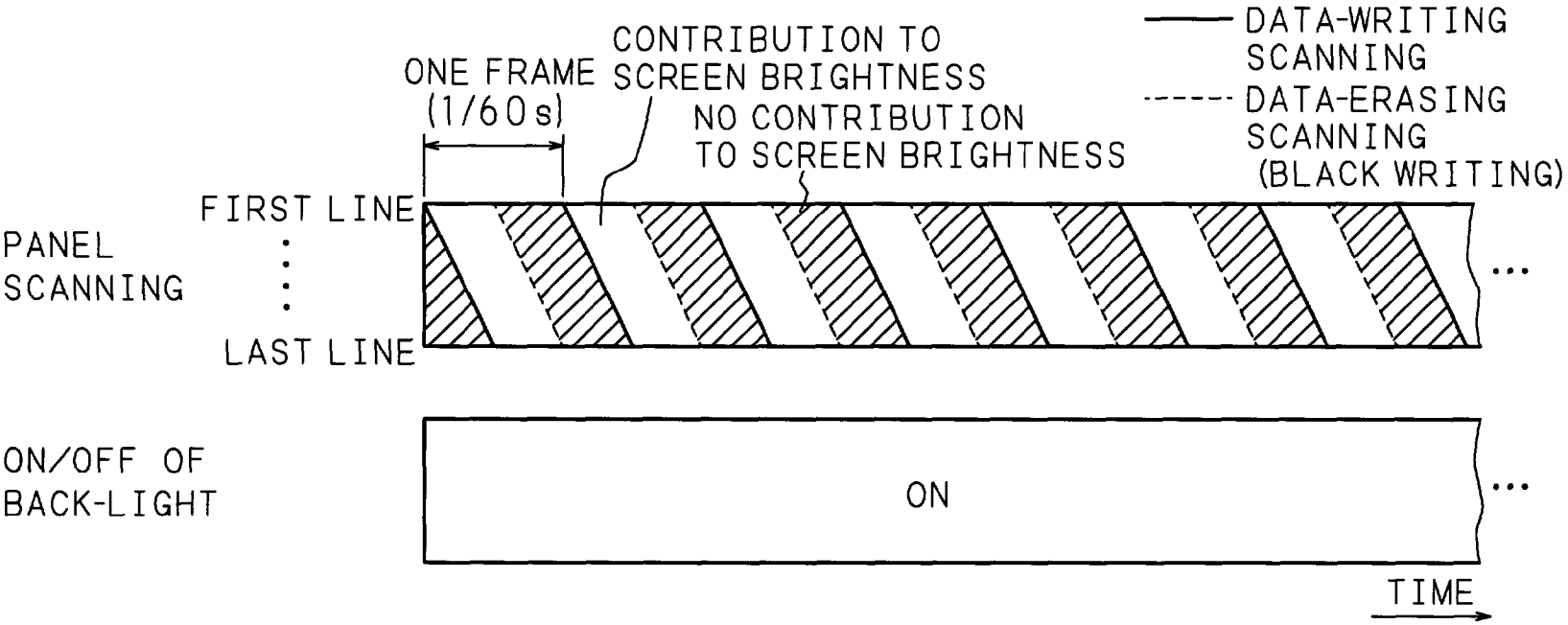
FIG. 2 PRIOR ART
FIG. 2 is an illustration showing a conventional drive sequence.

As a result, the time contributing to the screen brightness (a portion with no hatching in FIG. 6) became longer compared to the conventional example of FIG. 2, a light utilization efficiency (screen brightness/back-light brightness percentage) of 10% that was superior to the conventional example (6%) was achieved, and bright and clear display was obtained. Furthermore, since the charge amount in liquid crystal was made substantially zero and variations in the charge were eliminated by the erasure of the present invention, image sticking of display was reduced.

Second Embodiment

A liquid crystal display device was constructed by stacking the liquid crystal panel 1 fabricated under the same conditions as in the first embodiment and the back-light 26 formed of LEDs of easy switching.

Figure 7:
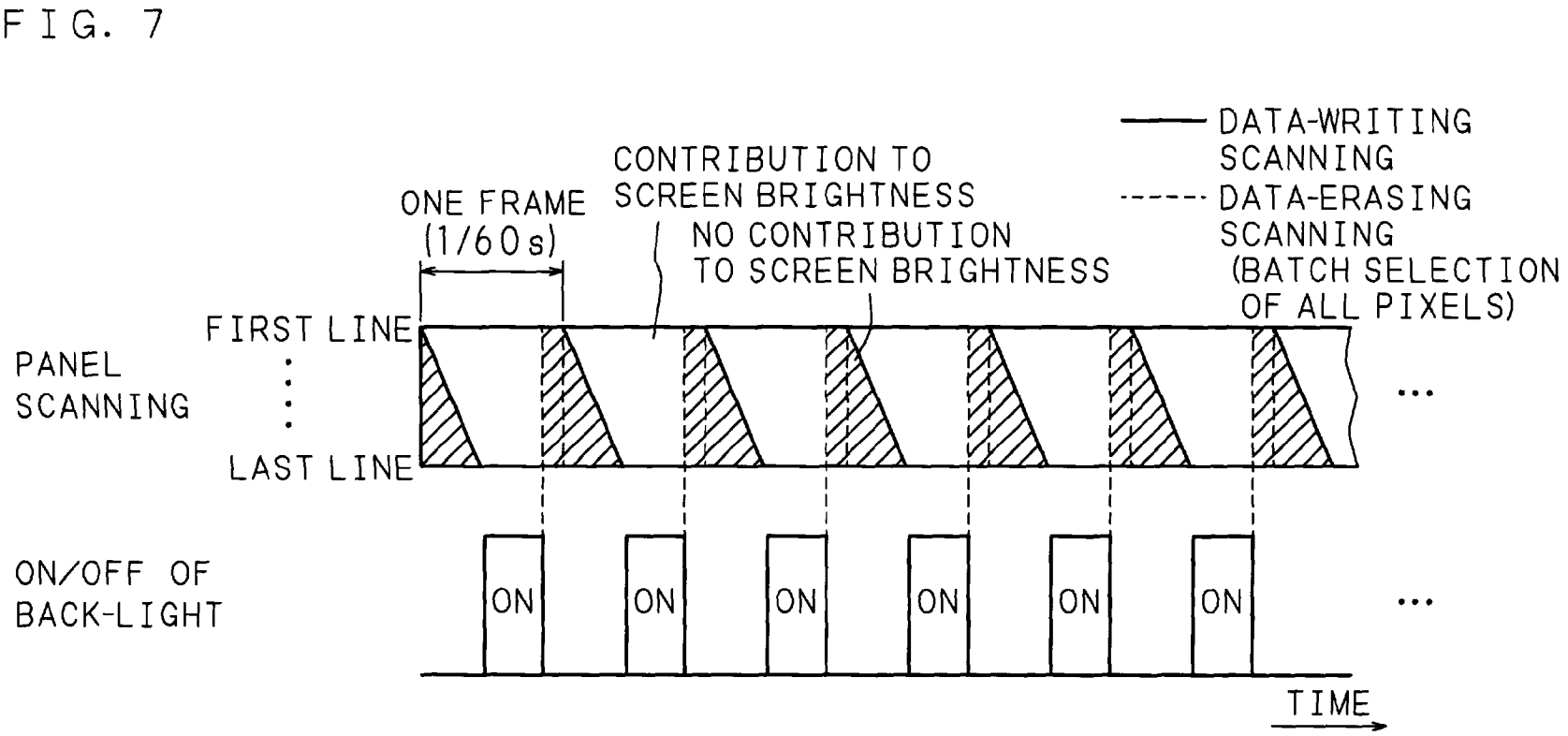
FIG. 7 is an illustration showing a drive sequence according to the second embodiment of the present invention.

In addition, according to the drive sequences shown in FIGS. 7 and 8, the TFTs 21 of the respective pixel electrodes 5 were driven on a line by line basis to apply a voltage corresponding to the image data. The selection period of each line was made 7 μs. The data-erasing scanning was performed twice.

The maximum applied voltage to the liquid crystal corresponding to the image data was made (Vcom+7) V, the first applied voltage to the liquid crystal by batch selection of all the pixel electrodes (batch selection of all the lines) during erasure was made (Vcom−8) V, and the second applied voltage was made equal to Vcom. Moreover, a time interval of 500 μs in which the liquid crystal can respond sufficiently was set between the first voltage application and the second voltage application. The time of one frame was made 1/60 s, and the above-described writing of the image data and two times of voltage application to the liquid crystal by batch selection of all the pixel electrodes (erasure) were designed to be completed within each frame.

As shown in FIG. 7, the back-light 26 was turned on only after data-writing scanning of all the pixel electrodes. In this manner, the utilization efficiency of the back-light 26 was increased.

As a result, a light utilization efficiency of 12% that was superior to the conventional example (6%) and the first embodiment (10%) was achieved, and bright and clear display was obtained. In addition, like the first embodiment, image sticking of display was reduced.

Third Embodiment

Like the first embodiment, after washing a TFT substrate having the pixel electrodes 5 (800×600 pixels with a diagonal length of 12.1 inches) and a common electrode substrate having the common electrode 2 and the RGB color filter/black matrix 3, they were coated with polyimide and then baked for one hour at 200° C. to form the alignment films 7 and 8 made of about 200 Å thick polyimide films.

Further, these alignment films 7 and 8 were rubbed with a cloth made of rayon, and stacked with a gap being maintained therebetween by the spacers 10 made of silica having an average particle size of 1.6 μm so as to fabricate an empty panel. A ferroelectric liquid crystal material composed mainly of naphthalene-based liquid crystals (for example, a material disclosed by A. Mochizuki, et. al.: Ferroelectrics, 133,353 (1991)) was sealed in this empty panel to form the liquid crystal layer 9. The magnitude of spontaneous polarization of the sealed ferroelectric liquid crystal material was 11 nC/cm$^2$.

The fabricated panel was sandwiched by two polarizing films 11 and 12 maintained in a crossed-Nicol state so that a dark state was produced when the long-axis direction of the ferroelectric liquid crystal molecules titled to one direction, thereby forming the liquid crystal panel 1. This liquid crystal panel 1 and the back-light 26 were stacked to construct a liquid crystal display device.

Figure 9:
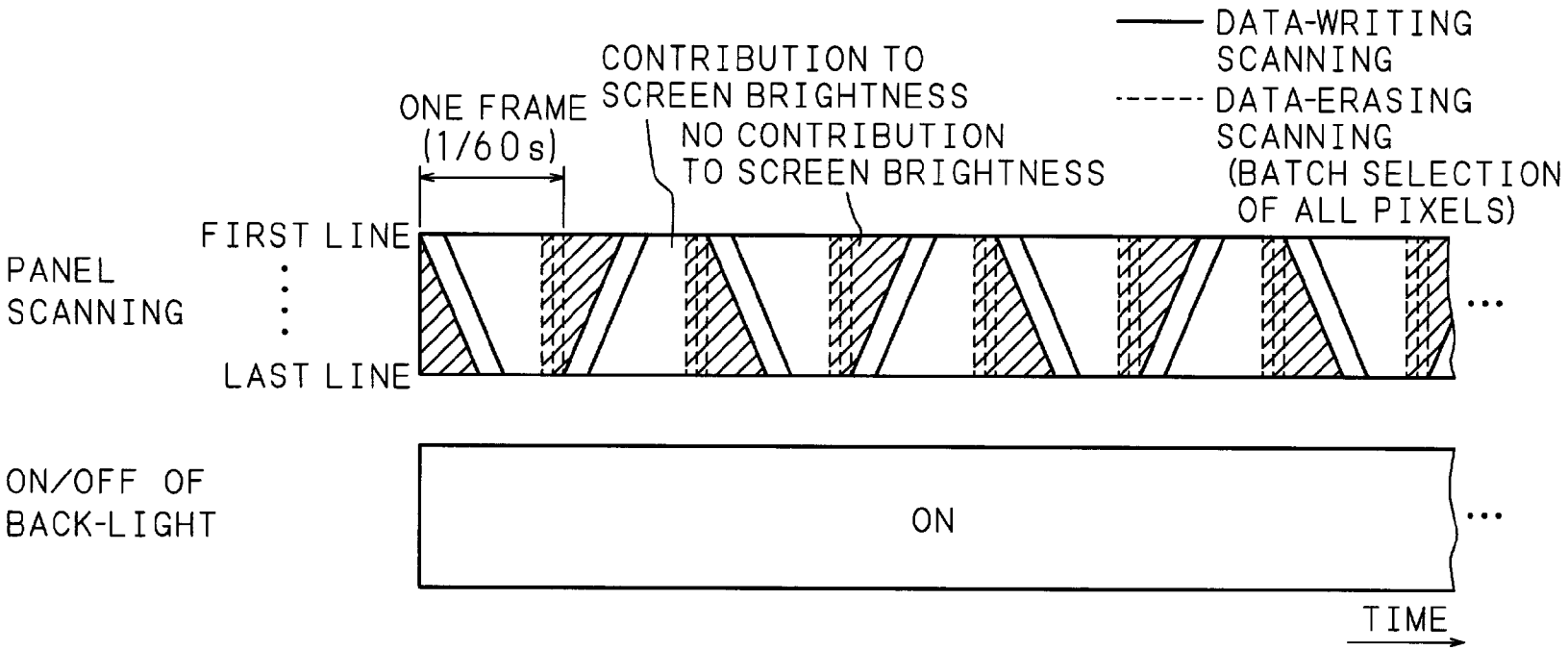
FIG. 9 is an illustration showing a drive sequence according to the third embodiment of the present invention.
Figure 11:
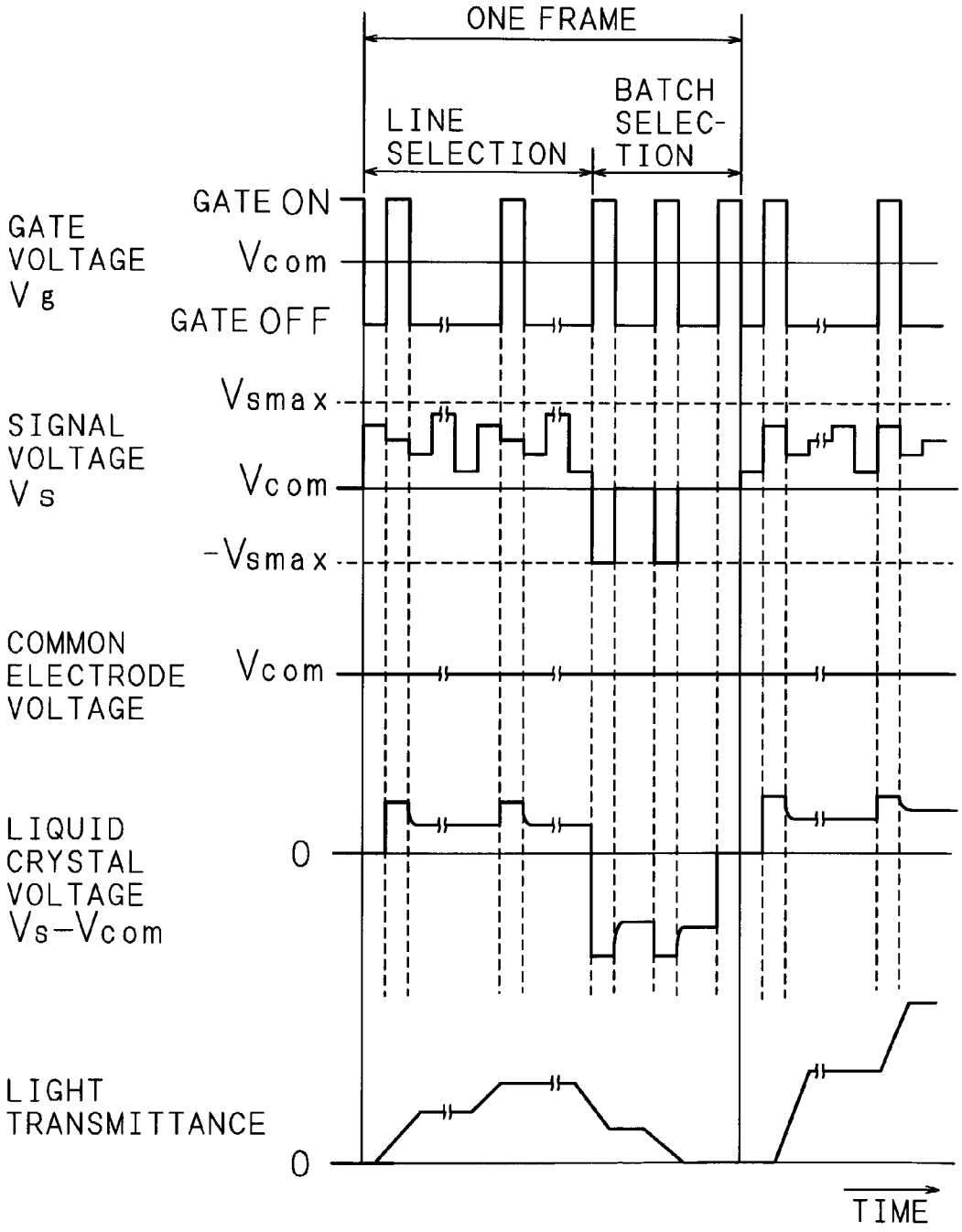
FIG. 11 is an illustration showing a drive sequence according to the third and fourth embodiments of the present invention.

Then, according to the drive sequences shown in FIGS. 9 and 11, the TFTs 21 of the respective pixel electrodes 5 were driven on a line by line basis to apply a voltage corresponding to the image data twice. The selection period of each line was made 7 μs, and the order of scanning lines is reversed between adjacent frames like the first embodiment so as to prevent variations in the screen brightness. The data-erasing scanning was performed three times.

The maximum applied voltage to the liquid crystal corresponding to the image data was made (Vcom+7) V, the first and second applied voltages to the liquid crystal by batch selection of all the pixel electrodes (batch selection of all the lines) during erasure were made (Vcom−7) V, and the third applied voltage was made equal to Vcom. Moreover, a time interval of 300 μs in which the liquid crystal can respond sufficiently was set between the first voltage application and the second voltage application and also between the second voltage application and the third voltage application. The time of one frame was made 1/60 s, and the above-described writing of the image data and three times of voltage application to the liquid crystal by batch selection of all the pixel electrodes (erasure) were designed to be completed within each frame. The back-light 26 was always turned on.

As a result, even when a ferroelectric liquid crystal having large spontaneous polarization was used, it was driven with a lower drive voltage (7 V) than that of the conventional example (12 V), a light utilization efficiency of 9% that was superior to the conventional example (6%) was achieved, and bright and clear display was obtained. In addition, like the first embodiment, image sticking of display was reduced.

Fourth Embodiment

A liquid crystal display device was constructed by stacking the liquid crystal panel 1 fabricated under the same conditions as in the third embodiment and the back-light 26 formed of LEDs of easy switching.

Figure 10:
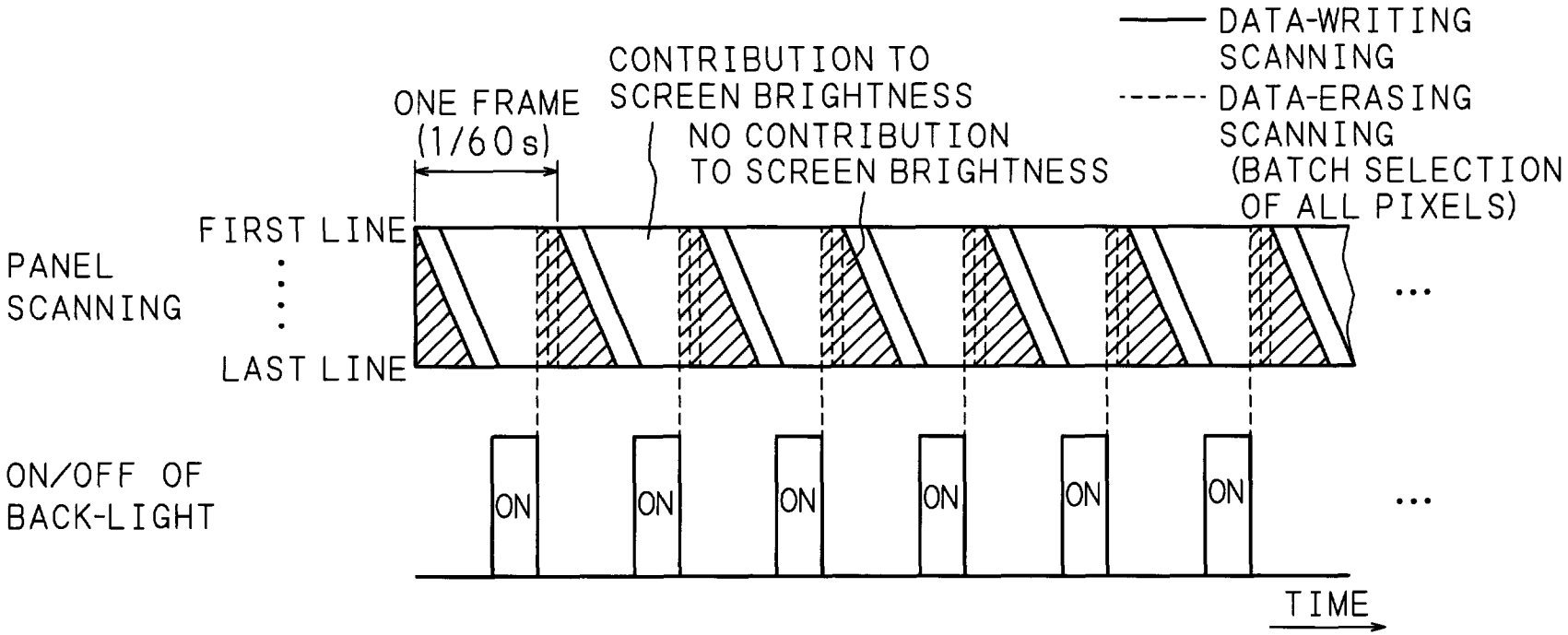
FIG. 10 is an illustration showing a drive sequence according to the fourth embodiment of the present invention.

In addition, according to the drive sequences shown in FIGS. 10 and 11, the TFTs 21 of the respective pixel electrodes 5 were driven on a line by line basis to apply a voltage corresponding to the image data. The selection period of each line was made 7 μs. The data-erasing scanning was performed three times.

The maximum applied voltage to the liquid crystal corresponding to the image data was made (Vcom+7) V, the first and second applied voltages to the liquid crystal by batch selection of all the pixel electrodes (batch selection of all the lines) during erasure was made (Vcom−7) V, and the third applied voltage was made equal to Vcom. Moreover, a time interval of 300 μs in which the liquid crystal can respond sufficiently was set between the first voltage application and the second voltage application and also between the second voltage application and the third voltage application. The time of one frame was made 1/60 s, and the above-described writing of the image data and three times of voltage application to the liquid crystal by batch selection of all the pixel electrodes (erasure) were designed to be completed within each frame.

As shown in FIG. 10, the back-light 26 was turned on only after the second data-writing scanning of all the pixel electrodes. In this manner, the utilization efficiency of the back-light 26 was increased.

As a result, even when a ferroelectric liquid crystal having large spontaneous polarization was used, it was driven with a low drive voltage of 7 V, a light utilization efficiency of 11% that was superior to the conventional example (6%) and the third embodiment (9%) was achieved, and bright and clear display was obtained. In addition, like the first embodiment, image sticking of display was reduced.

Fifth Embodiment

First, the liquid crystal panel 1 shown in FIGS. 4 and 5 was fabricated as follows. After washing a TFT substrate having the pixel electrodes 5 (800×600 pixels with a diagonal length of 12.1 inches) and a common electrode substrate having the common electrode 2 and the RGB color filter/black matrix 3, they were coated with polyimide and then baked for one hour at 200° C. to form the alignment films 7 and 8 made of about 200 Å thick polyimide films.

Further, these alignment films 7 and 8 were rubbed with a cloth made of rayon, and stacked with a gap being maintained therebetween by the spacers 10 made of silica having an average particle size of 1.6 μm so as to fabricate an empty panel. The rubbing direction was antiparallel. A bistable ferroelectric liquid crystal material was sealed in this empty panel to form the liquid crystal layer 9. The magnitude of spontaneous polarization of the sealed ferroelectric liquid crystal material was 6 nC/cm$^2$.

The fabricated panel was sandwiched by two polarizing films 11 and 12 maintained in a crossed-Nicol state so that a dark state was produced when the long-axis direction of the ferroelectric liquid crystal molecules of the liquid crystal layer 9 titled to one direction, thereby forming the liquid crystal panel 1. This liquid crystal panel 1 and the back-light 26 were stacked to construct a liquid crystal display device.

Figure 12:
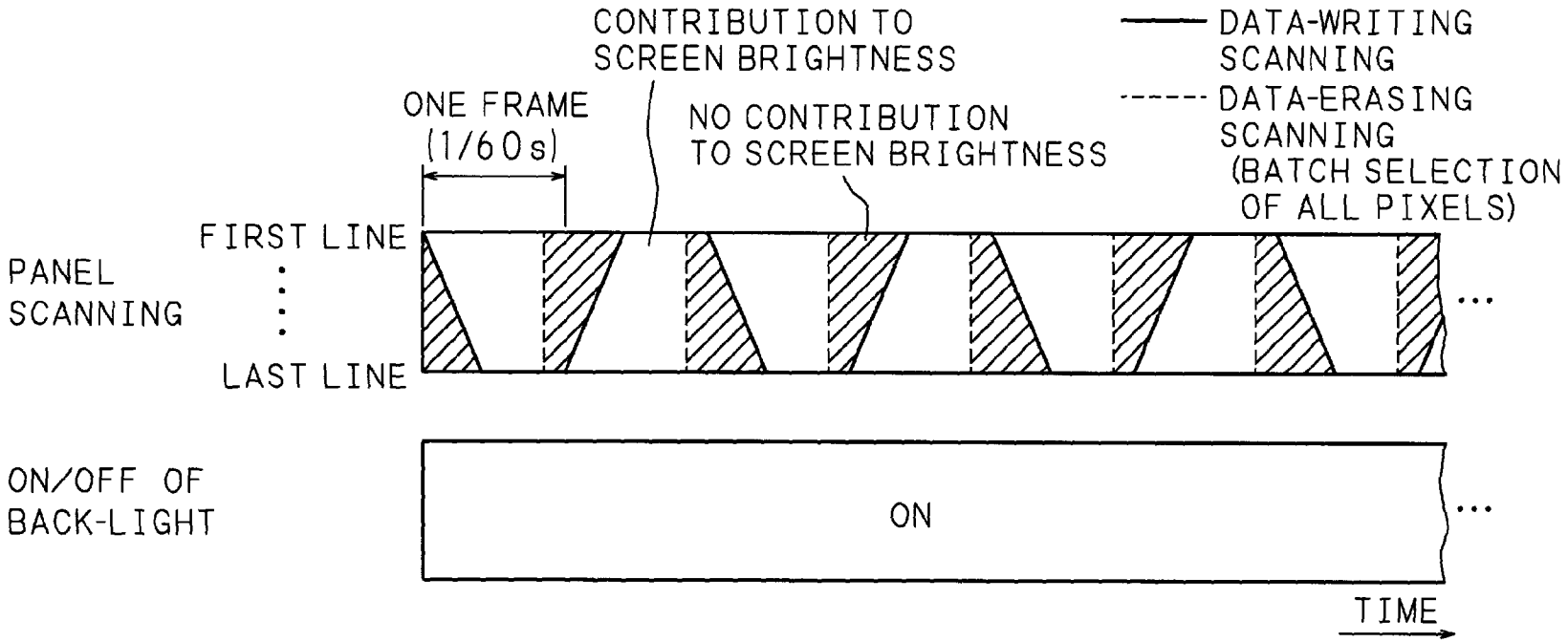
FIG. 12 is an illustration showing a drive sequence according to the fifth embodiment of the present invention.
Figure 14:
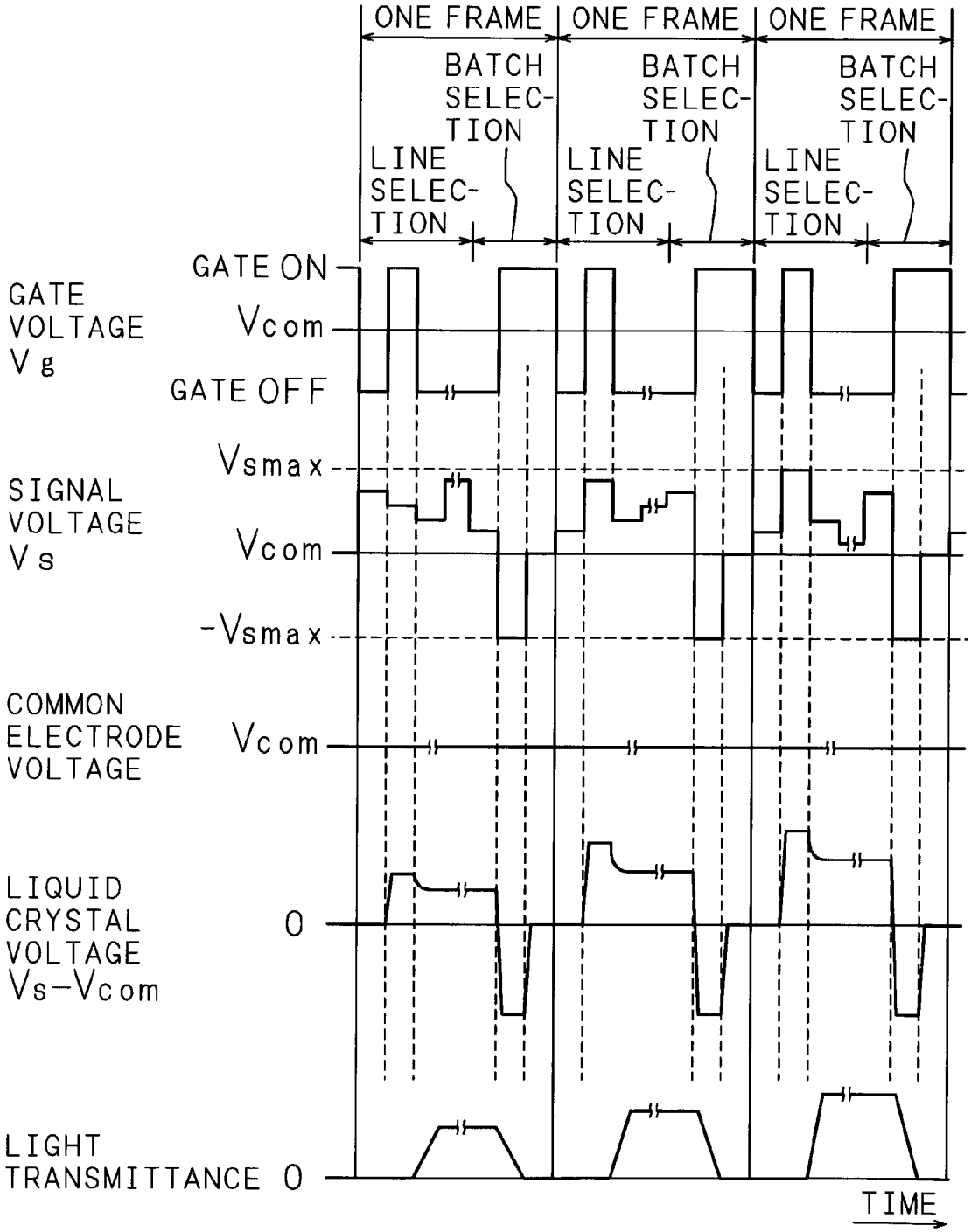
FIG. 14 is an illustration showing a drive sequence according to the fifth and sixth embodiments of the present invention.

Next, according to the drive sequences shown in FIGS. 12 and 14, the TFTs 21 of the respective pixel electrodes 5 were driven on a line by line basis to apply a voltage corresponding to the image data. The selection period of each line was 7 μs, and the time necessary for the entire writing was (7×n) μs (n is the number of lines). According to the conventional drive sequence shown in FIG. 2, since the selection period of each line was 13 μs, the speed was increased compared to the conventional example. Note that the order of scanning lines was reversed between adjacent frames so as to prevent variations in the screen brightness. The data-erasing scanning was performed once.

The maximum applied voltage to the liquid crystal corresponding to the image data was made (Vcom+7) V, the first applied voltage to the liquid crystal by batch selection of all the pixel electrodes (batch selection of all the lines) during erasure was made (Vcom−7) V, and the second applied voltage was made equal to Vcom. Further, the time of the batch selection of all the pixel electrodes was set 300 μs in which the liquid crystal could respond sufficiently, and the first voltage application time and the second voltage application time were set 280 μs and 20 μs, respectively. The time of one frame was made 1/60 s, and the above-described writing of the image data and two times of voltage application to the liquid crystal by batch selection of all the pixel electrodes were designed to be completed within each frame. The back-light 26 was always turned on.

As a result, the time contributing to the screen brightness (a portion with no hatching in FIG. 12) became longer compared to the conventional example of FIG. 2, a light utilization efficiency of 10% that was superior to the conventional example (6%) was achieved, and a bright and clear display was obtained. In addition, like the first embodiment, image sticking of display was reduced.

Sixth Embodiment

An empty panel was fabricated under the same conditions as in the fifth embodiment. However, the rubbing direction was made parallel. A monostable ferroelectric liquid crystal material was sealed in this empty panel to form the liquid crystal layer 9. The magnitude of spontaneous polarization of the sealed ferroelectric liquid crystal material was 6 nC/cm$^2$.

The fabricated panel was sandwiched by two polarizing films 11 and 12 maintained in a crossed-Nicol state so that a dark state was produced when the long-axis direction of the ferroelectric liquid crystal molecules of the liquid crystal layer 9 was in the direction of no voltage application, thereby forming the liquid crystal panel 1. This liquid crystal panel 1 and the back-light 26 were stacked to construct a liquid crystal display device.

Figure 13:
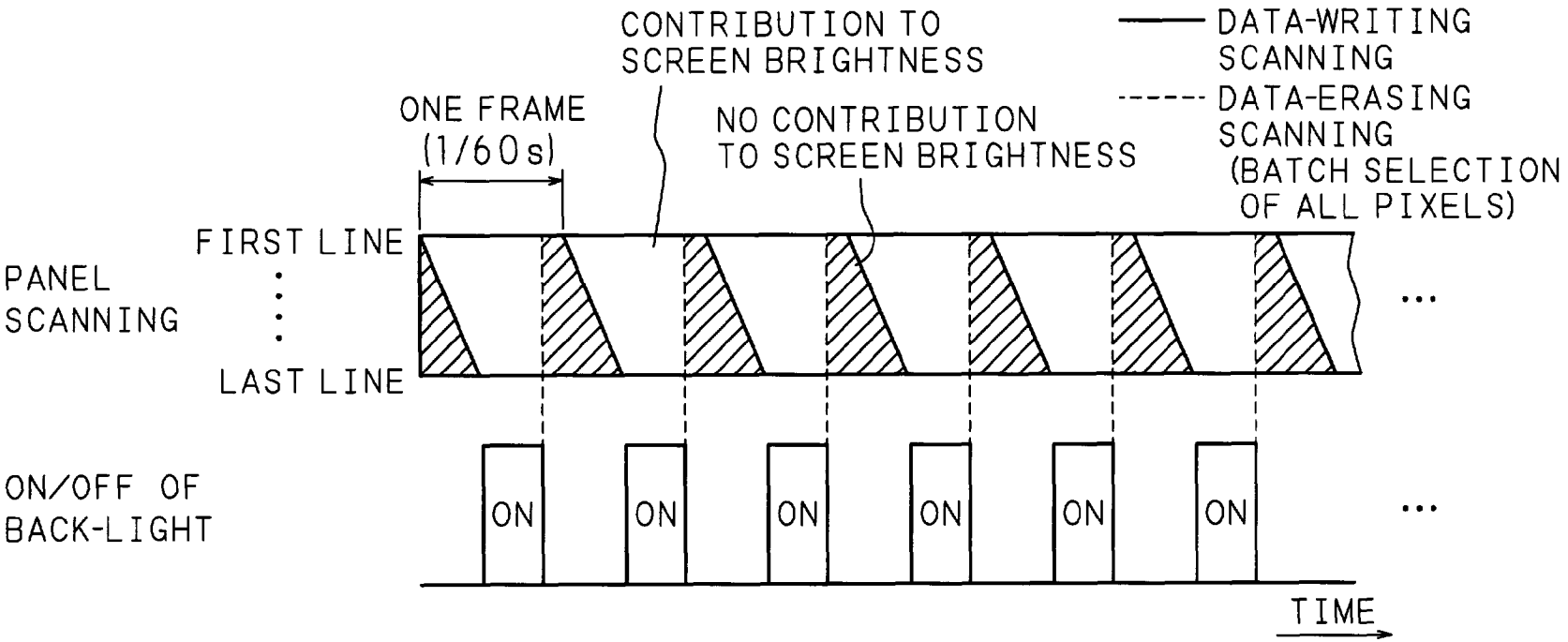
FIG. 13 is an illustration showing a drive sequence according to the sixth embodiment of the present invention.

Next, according to the drive sequences shown in FIGS. 13 and 14, the TFTs 21 of the respective pixel electrodes 5 were driven on a line by line basis to apply a voltage corresponding to the image data. The selection period of each line was made 7 μs. The data-erasing scanning was performed once.

The maximum applied voltage to the liquid crystal corresponding to the image data was made (Vcom+7) V, the first applied voltage to the liquid crystal by batch selection of all the pixel electrodes (batch selection of all the lines) during erasure was made (Vcom−8) V, and the second applied voltage was made equal to Vcom. Further, the time of the batch selection of all the pixel electrodes was set 250 μs in which the liquid crystal could respond sufficiently, and the first voltage application time and the second voltage application time were set 225 μs and 25 μs, respectively. The time of one frame was made 1/60 s, and the above-described writing of the image data and two times of voltage application to the liquid crystal by batch selection of all the pixel electrodes were designed to be completed within each frame.

As shown in FIG. 13, the back-light 26 was turned on only after the data-writing scanning to all the pixel electrodes. In this manner, the utilization efficiency of the back-light 26 was improved.

As a result, a light utilization efficiency of 12% which was superior to the conventional example (6%) and the fifth embodiment (10%) was achieved, and a bright and clear display was obtained. In addition, like the first embodiment, image sticking of display was reduced.

Seventh Embodiment

An empty panel was fabricated under the same conditions as in the sixth embodiment. A bistable ferroelectric liquid crystal material was sealed in this empty panel to form the liquid crystal layer 9. The magnitude of spontaneous polarization of the sealed ferroelectric liquid crystal material was 11 nC/cm$^2$.

The fabricated panel was sandwiched by two polarizing films 11 and 12 maintained in a crossed-Nicol state so that a dark state was produced when the long-axis direction of the ferroelectric liquid crystal molecules of the liquid crystal layer 9 titled to one direction, thereby forming the liquid crystal panel 1. This liquid crystal panel 1 and the back-light 26 were stacked to construct a liquid crystal display device.

Figure 15:
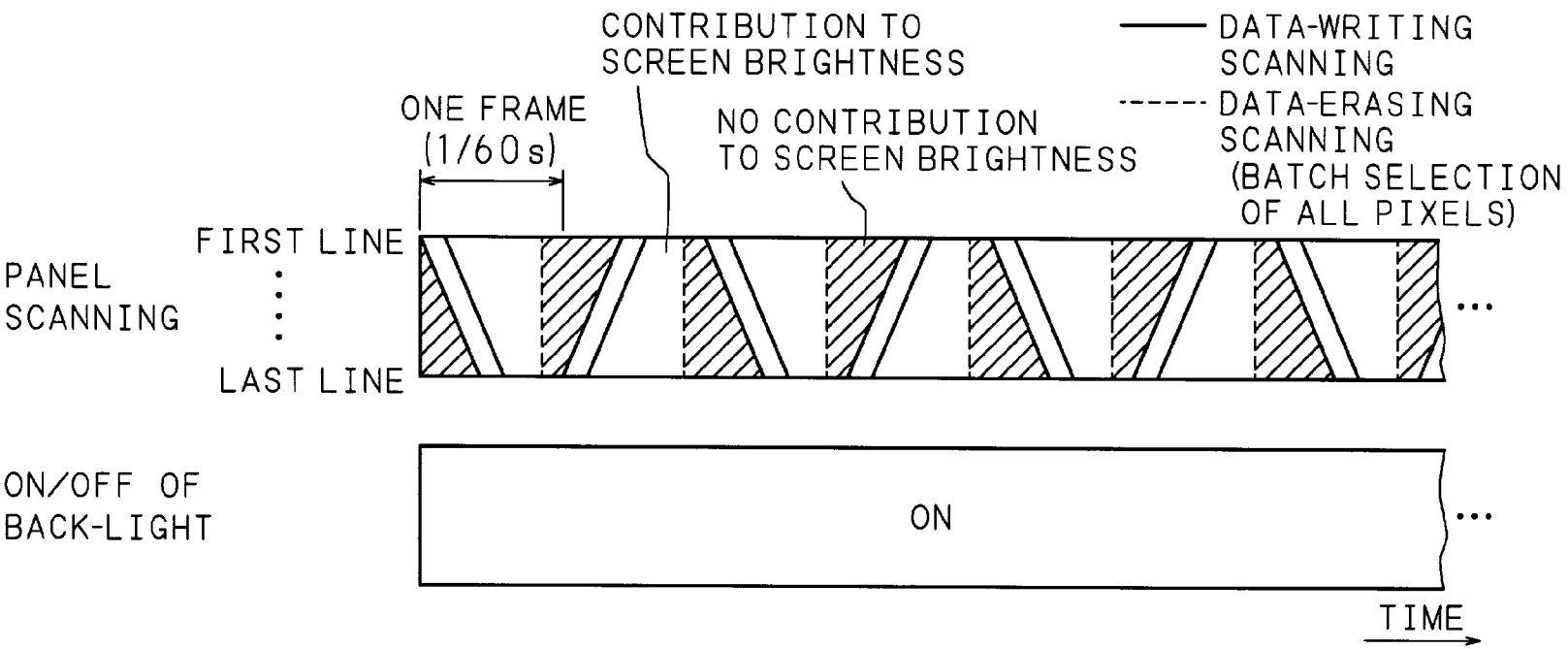
FIG. 15 is an illustration showing a drive sequence according to the seventh embodiment of the present invention.
Figure 17:
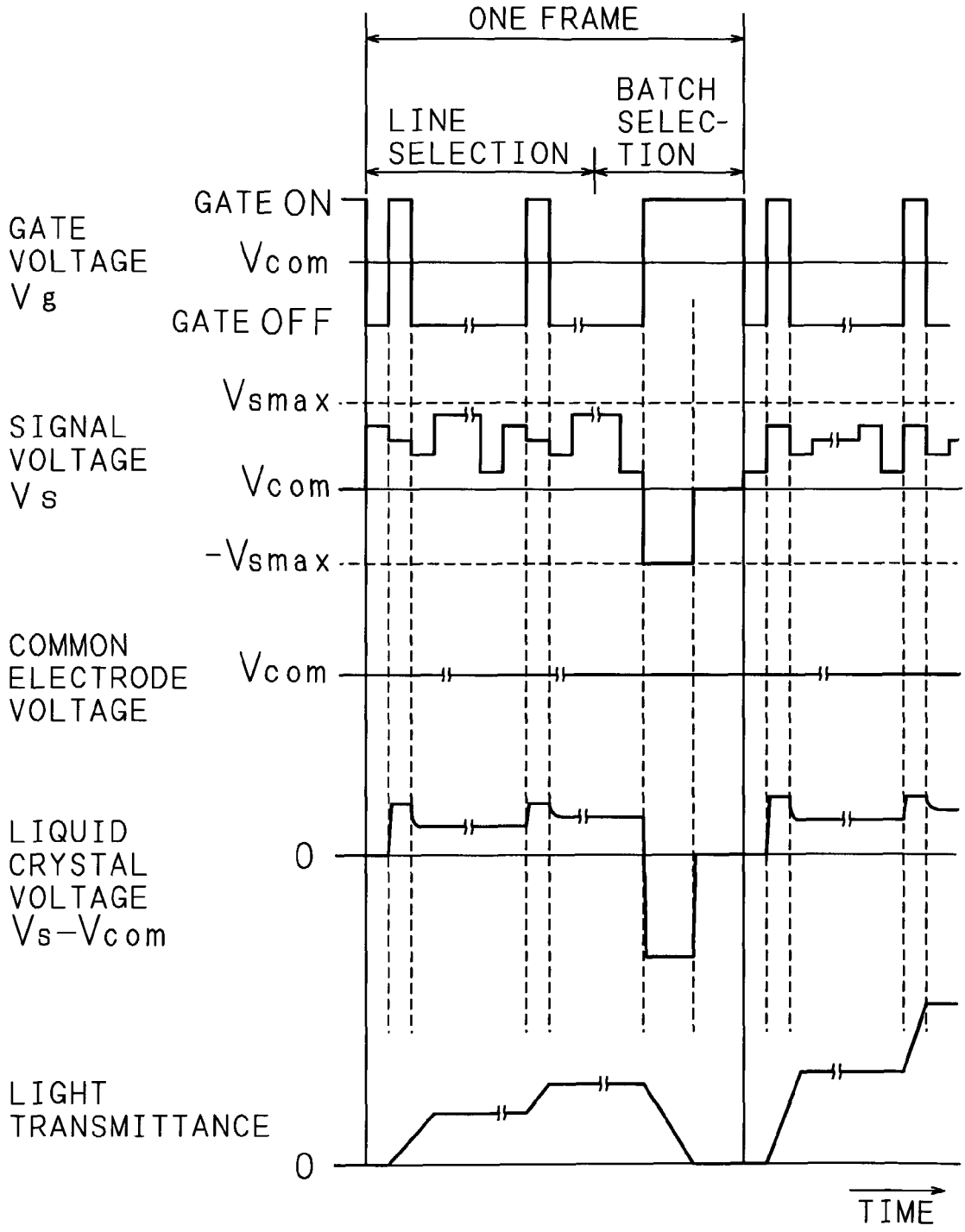
FIG. 17 is an illustration showing a drive sequence according to the seventh and eighth embodiments of the present invention.

Next, according to the drive sequences shown in FIGS. 15 and 17, the TFTs 21 of the respective pixel electrodes 5 were driven on a line by line basis to apply a voltage corresponding to the image data twice. The selection period of each line was made 7 μs. Note that the order of scanning lines was reversed between adjacent frames so as to prevent variations in the screen brightness. The data-erasing scanning was performed once.

The maximum applied voltage to the liquid crystal corresponding to the image data was made (Vcom+7) V, the first applied voltage to the liquid crystal by batch selection of all the pixel electrodes (batch selection of all the lines) during erasure was made (Vcom−7) V, and the second applied voltage was made equal to Vcom. Further, the time of the batch selection of all the pixel electrodes was set 200 μs in which the liquid crystal could respond sufficiently, and the first voltage application time and the second voltage application time were set 180 μs and 20 μs, respectively. The time of one frame was made 1/60 s, and the above-described writing of the image data and two times of voltage application to the liquid crystal by batch selection of all the pixel electrodes were designed to be completed within each frame.

As a result, even when a ferroelectric liquid crystal with large spontaneous polarization was used, it was possible to drive the liquid crystal display device by a drive voltage (7 V) lower than the conventional example (12 V), and a light utilization efficiency of 9% which was superior to the conventional example (6%) was achieved and a bright and clear display was obtained. In addition, like the first embodiment, image sticking of display was reduced.

Eighth Embodiment

An empty panel was fabricated under the same conditions as in the fifth embodiment. A monostable ferroelectric liquid crystal material was sealed in this empty panel to form the liquid crystal layer 9. The magnitude of spontaneous polarization of the sealed ferroelectric liquid crystal material was 11 nC/cm$^2$.

The fabricated panel was sandwiched by two polarizing films 11 and 12 maintained in a crossed-Nicol state so that a dark state was produced when the long-axis direction of the ferroelectric liquid crystal molecules of the liquid crystal layer 9 was in the direction of no voltage application, thereby forming the liquid crystal panel 1. This liquid crystal panel 1 and the back-light 26 were stacked to construct a liquid crystal display device.

Figure 16:
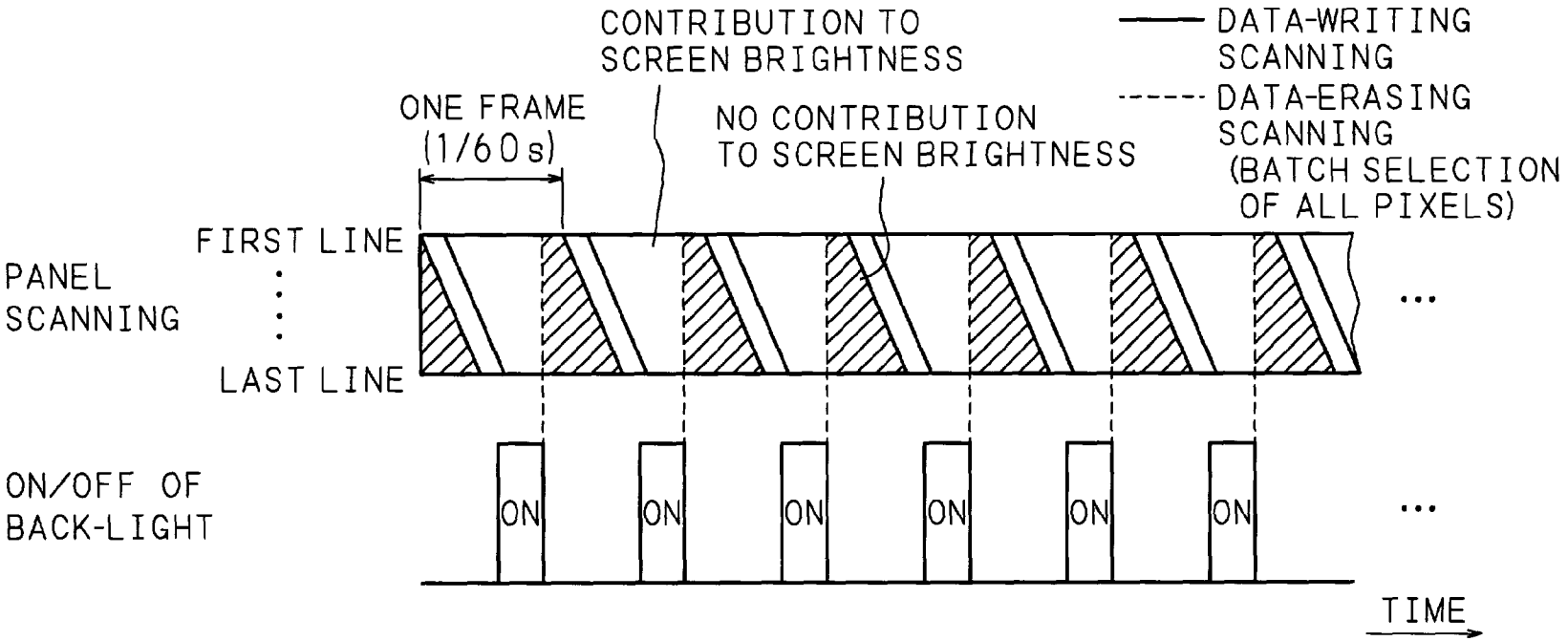
FIG. 16 is an illustration showing a drive sequence according to the eighth embodiment of the present invention.

Next, according to the drive sequences shown in FIGS. 16 and 17, the TFTs 21 of the respective pixel electrodes 5 were driven on a line by line basis to apply a voltage corresponding to the image data twice. The selection period of each line was made 7 μs. The data-erasing scanning was performed once.

The maximum applied voltage to the liquid crystal corresponding to the image data was made (Vcom+7) V, the first applied voltage to the liquid crystal by batch selection of all the pixel electrodes (batch selection of all the lines) during erasure was made (Vcom−7) V, and the second applied voltage was made equal to Vcom. Further, the time of the batch selection of all the pixel electrodes was set 200 μs in which the liquid crystal could respond sufficiently, and the first voltage application time and the second voltage application time were set 180 μs and 20 μs, respectively. The time of one frame was made 1/60 s, and the above-described writing of the image data and two times of voltage application to the liquid crystal by batch selection of all the pixel electrodes were designed to be completed within each frame.

As a result, even when a ferroelectric liquid crystal with large spontaneous polarization was used, it was possible to drive the liquid crystal display device by a drive voltage (7 V) lower than the conventional example (12 V), and a light utilization efficiency of 11% which was superior to the conventional example (6%) was achieved and a bright and clear display was obtained. In addition, like the first embodiment, image sticking of display was reduced.

Ninth Embodiment

While the above-described embodiments illustrate examples in which a light source 26*a* of white color light is used and color display is realized by selectively transmitting the white color light by using the color filters, it is of course possible to apply the present invention to a field-sequential type liquid crystal display device that achieves color display by using a light source for emitting light of a plurality of colors as the back-light, switching the colors of the light emitted by the back-light and synchronizing the switching of the colors of the emitted light and the switching of the liquid crystal.

Figure 18:
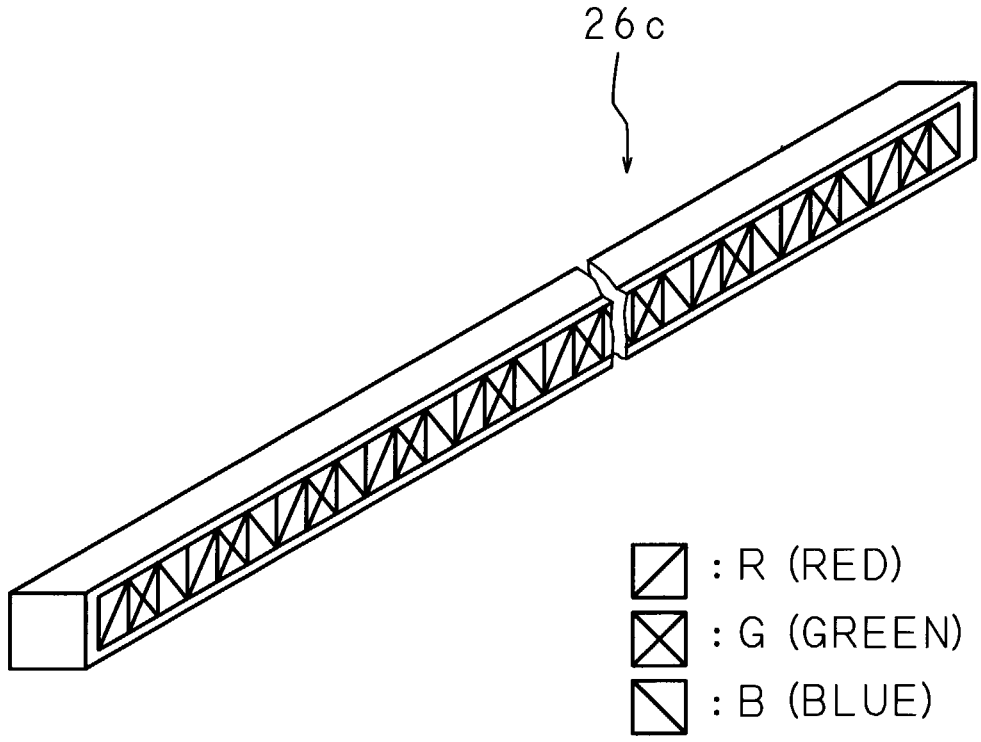
FIG. 18 is a schematic view showing an example of the structure of a light source (LED array) according to the ninth embodiment of the present invention.
Figure 19:
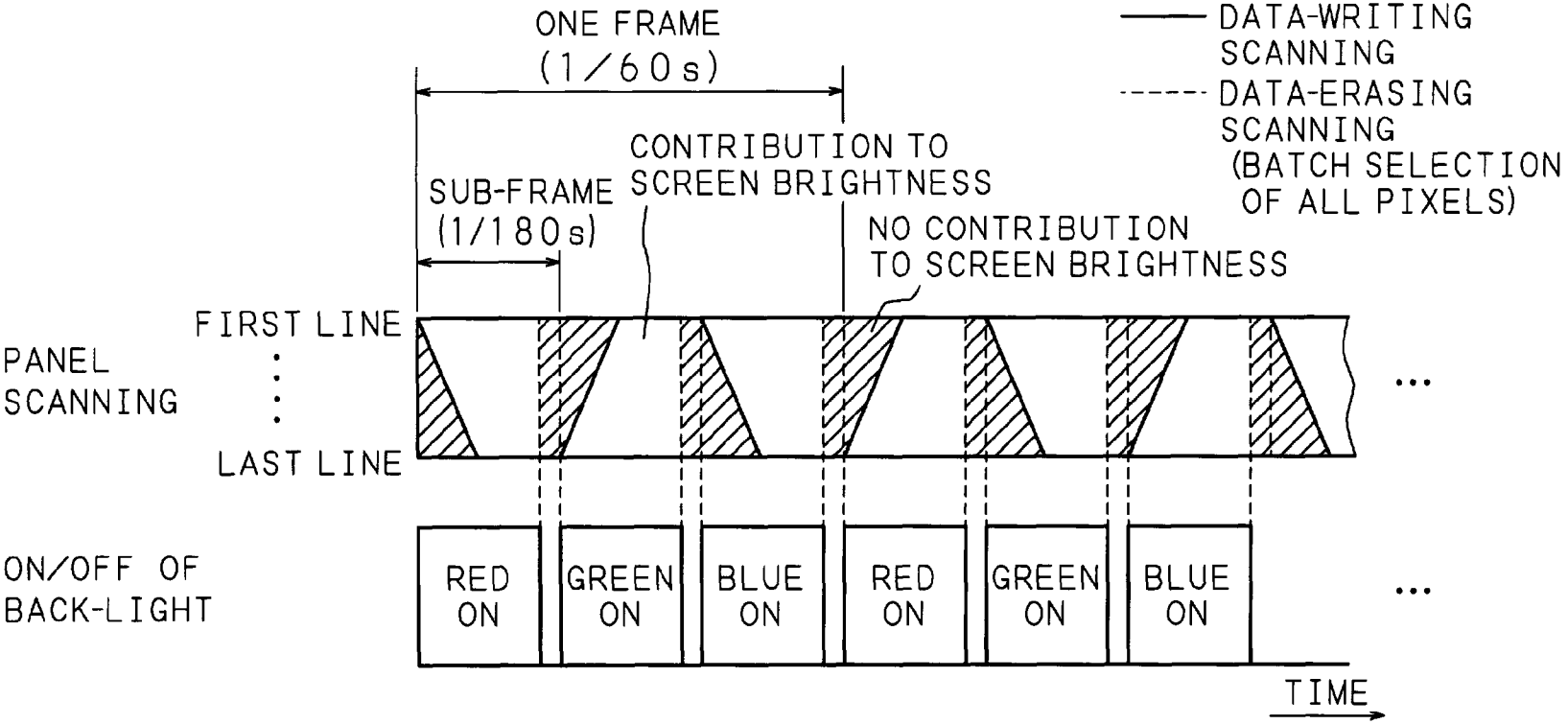
FIG. 19 is an illustration showing an example of a drive sequence according to the ninth embodiment of the present invention.
Figure 20:
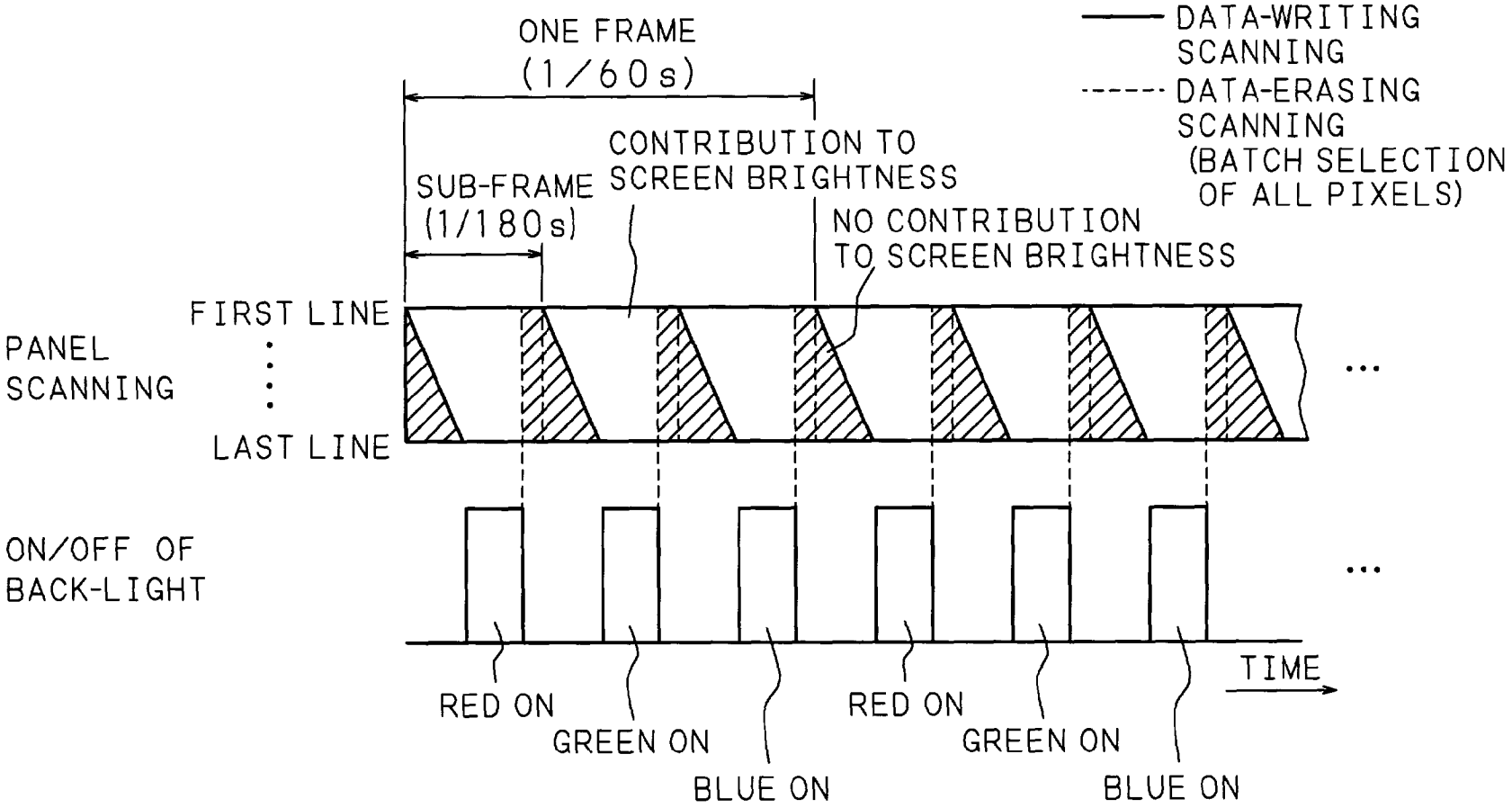
FIG. 20 is an illustration showing another example of a drive sequence according to the ninth embodiment of the present invention.
Figure 21:
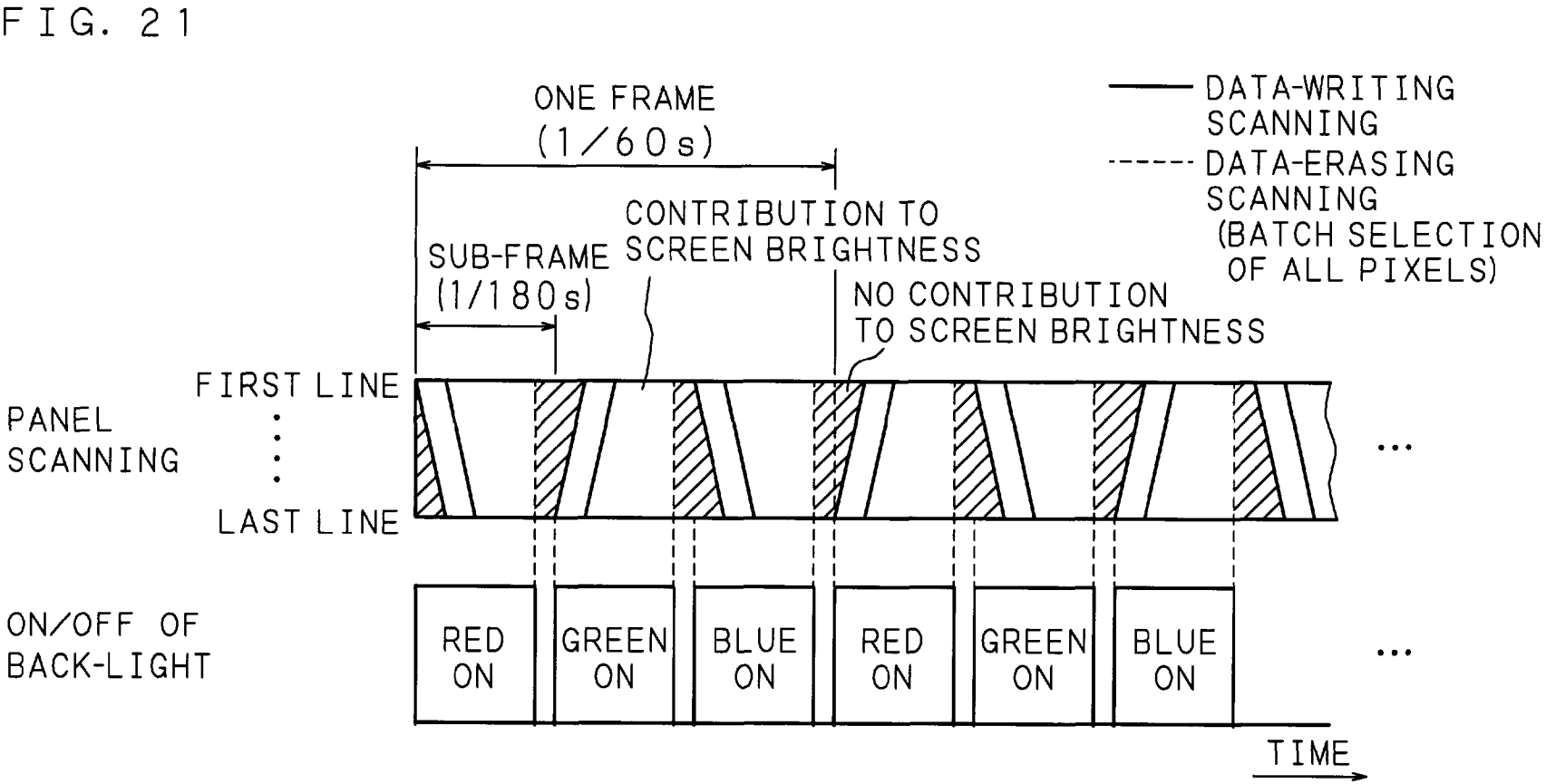
FIG. 21 is an illustration showing still another example of a drive sequence according to the ninth embodiment of the present invention.
Figure 22:
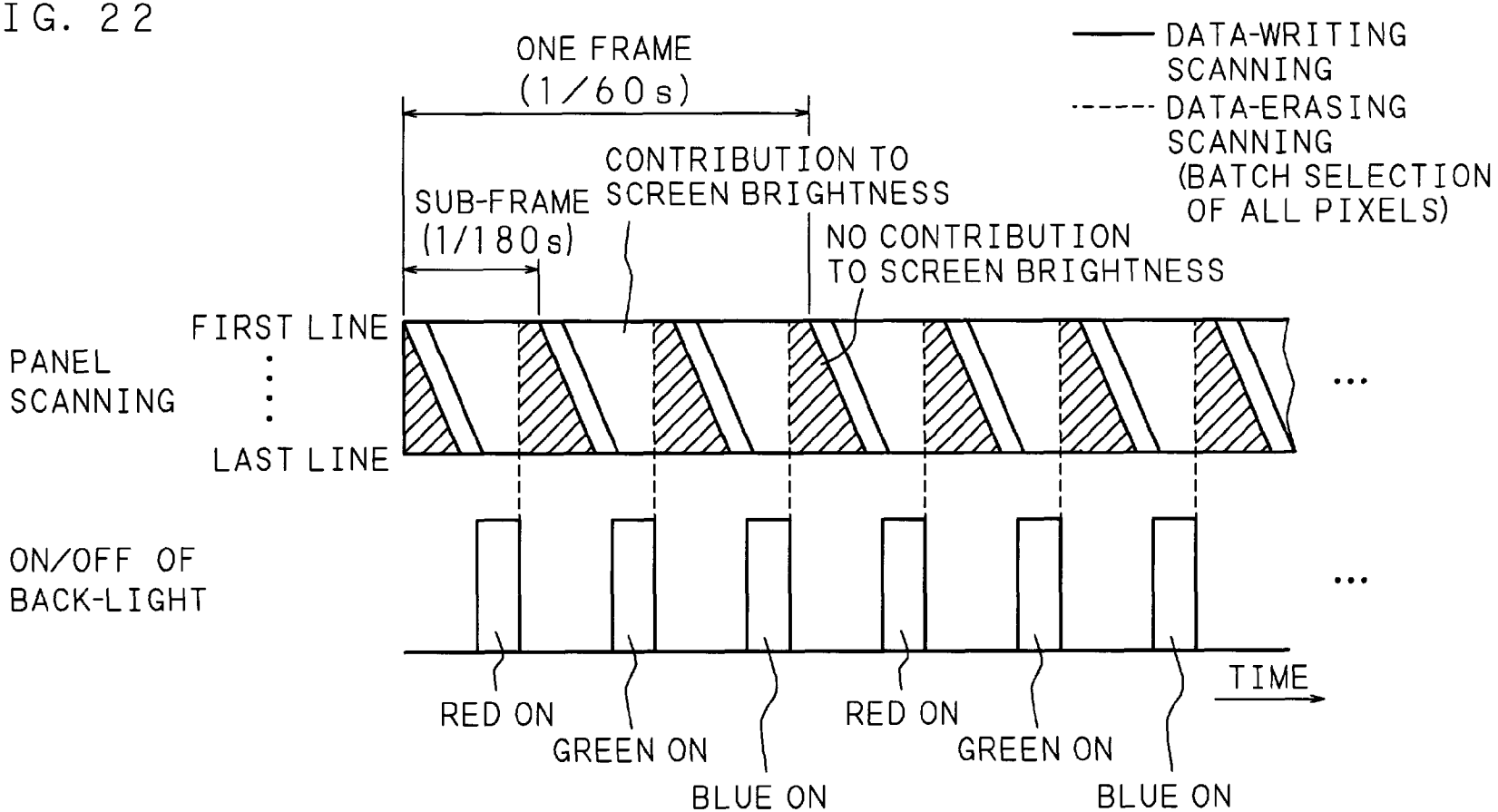
FIG. 22 is an illustration showing yet another example of a drive sequence according to the ninth embodiment of the present invention.
Figure 23:
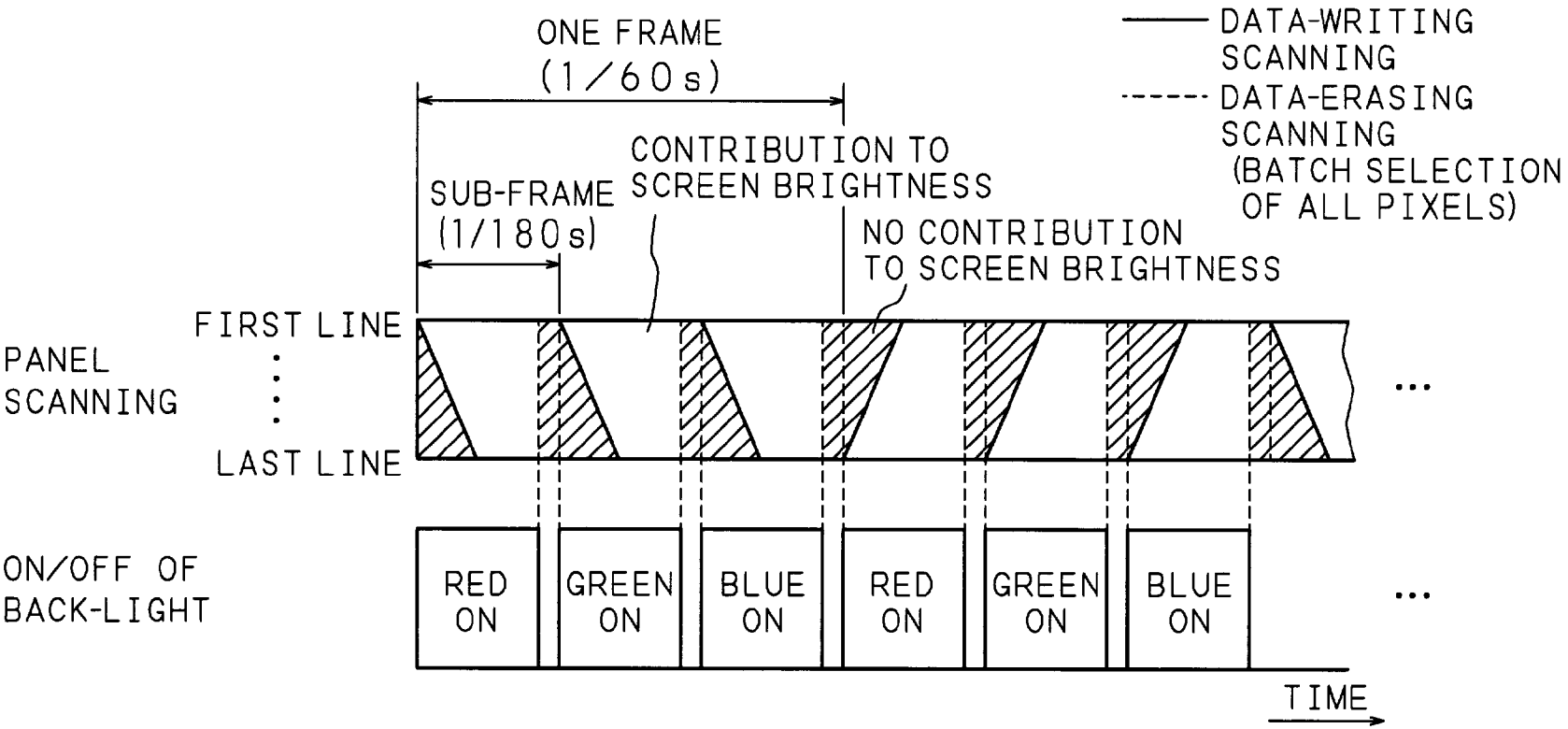
FIG. 23 is an illustration showing yet another example of a drive sequence according to the ninth embodiment of the present invention.
Figure 24:
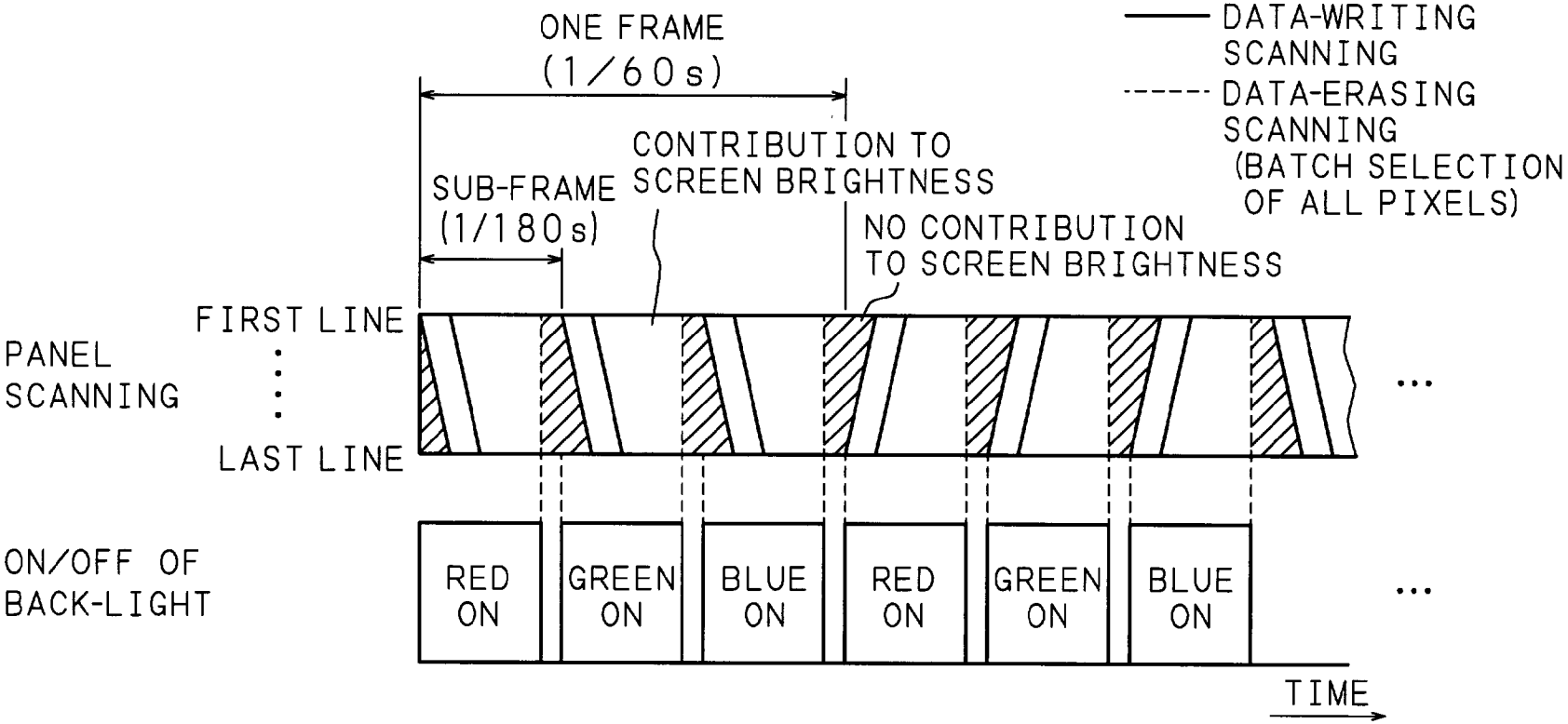
FIG. 24 is an illustration showing yet another example of a drive sequence according to the ninth embodiment of the present invention.

FIG. 18 is a schematic view showing an example of the structure of a light source 26*c* in such a field-sequential type liquid crystal display device. This light source 26*c* is an LED array in which LEDs for emitting three primary colors, namely, red (R), green (G) and blue (B), are sequentially and repeatedly aligned on a plane facing a light guiding and light-diffusion plate 26*b*. The back-light 26 comprises this light source 26*c* (LED array) and light guiding and light diffusion plate 26*b*.

Then, one frame of 1/60 seconds is divided into three sub-frames of 1/180 seconds, and the red, green and blue LEDs are caused to emit light sequentially in the first through third sub-frames, respectively. By switching the respective pixels on a line by line basis in synchronism with such sequential emission of light of the respective colors, color display is provided. In each the sub-frames of the red, green and blue colors, data-writing scanning is performed once or twice, and data-erasing scanning is carried out once or twice. Examples of such a drive sequence are illustrated in FIG. 19 through FIG. 24. In the examples shown in FIG. 19, FIG. 20 and FIG. 23, the data-writing scanning is performed once and the data-erasing scanning is carried out twice, while, in the examples shown in FIG. 21, FIG. 22 and FIG. 24, the data-writing scanning is performed twice and the data-erasing scanning is carried out once.

Further, in the ninth embodiment, during the erasure of data in each sub-frame, all the pixel electrodes are selected simultaneously and a voltage is applied to the pixel electrodes a plurality of times, according to a drive sequence as shown in FIG. 8, FIG. 11, FIG. 14 or FIG. 17.

Note that, in the above-described examples, while all the pixel electrodes are simultaneously selected and a voltage is applied thereto, it is also possible to produce a black display state in each pixel and make the stored charge amount in the liquid crystal of each pixel substantially zero by repeating batch selection of the pixel electrodes of a plurality of lines and application of a voltage thereto.

Moreover, while the examples using bistable or monostable ferroelectric liquid crystals as the liquid crystal material are explained, it is also possible to adopt antiferroelectric liquid crystal or other liquid crystal materials (nematic liquid crystal, cholesteric liquid crystal, etc.).

As described above, in the present invention, since voltage application to the liquid crystal material by batch selection of a part or all of the pixel electrodes is performed a plurality of times during erasure of data, it is possible to improve the light utilization efficiency. Furthermore, since the charge amount in liquid crystal is made substantially zero and variations in the charge are eliminated by the erasure of the present invention, it is possible to reduce image sticking of display.

Besides, since the voltage application to the liquid crystal material corresponding to the image data is carried out a plurality of times during writing, it is possible to use a liquid crystal material having large spontaneous polarization and excellent response characteristics and to reduce the drive voltage.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A method for driving a liquid crystal display device having a common electrode, a plurality of pixel electrodes distributed along each of a plurality of scanning lines, a liquid crystal material having spontaneous polarization sealed between the common electrode and the plurality of pixel electrodes, switching elements provided for the plurality of pixel electrodes, respectively, for controlling voltage application to the liquid crystal material, and a back-light for generating light, said method comprising the steps of:

writing image data by applying a voltage in a first voltage application to the liquid crystal material corresponding to each of the plurality of pixel electrodes and a second voltage application to the liquid crystal material corresponding to each of the plurality of pixel electrodes, in each frame; and erasing the image data by applying a plurality of different voltages having different voltage levels discretely to the liquid crystal material corresponding to each of the plurality of pixel electrodes to make a voltage value of the liquid crystal material become zero, wherein during the erasure of image data, a single batch selection is performed by applying a gate signal to at least two or all of the plurality of scanning lines, and each of the different voltages is applied simultaneously to the pixel electrodes corresponding to the at least two or all of the plurality of scanning lines in a period of the single batch selection for erasing the image data and equalizing the voltages being applied to the liquid crystal material between the common electrode and each of the plurality of pixel electrodes, the batch selection being performed periodically, the different voltages are applied separately during the single batch selection, a first of the different voltages having a value not smaller than a maximum value of the voltage applied in writing the image data and a different polarity than the voltage applied in writing the image data, and the last of the different voltages having a same value as a voltage on the common electrode, the plurality of the scanning lines for erasing data are selected simultaneously during the erasure of the data, the back-light, within each frame, is turned on after the first voltage application and from substantially at an end of the second voltage application to the liquid crystal material corresponding to each of the plurality of pixel electrodes during the writing of the image date, and turned off at a start of the erasing of the image data, and wherein further during the erasure of the data image, a time of application of the last of the different voltages is set to be equal to or less than one tenth of a time of application of the first of the different voltages.

2. The driving method of a liquid crystal display device of claim 1, wherein the single batch selection period is longer than a time necessary for a response of the liquid crystal material.

3. A liquid crystal display device comprising:

a liquid crystal panel including a common electrode, a plurality of pixel electrodes distributed along each of a plurality of scanning lines, a liquid crystal material having spontaneous polarization sealed between the common electrode and the plurality of pixel electrodes, and switching elements provided for the plurality of pixel electrodes, respectively, for controlling voltage application to the liquid crystal material;

a driving unit for writing image data by applying a voltage in a first voltage application to the liquid crystal material corresponding to each of the plurality of pixel electrodes and a second voltage application to the liquid crystal material corresponding to each of the plurality of pixel electrodes, in each frame, and erasing the image data on said liquid crystal panel by applying a plurality of different voltages having different voltage levels discretely to the liquid crystal material corresponding to each of the plurality of pixel electrodes to make a voltage value of the liquid crystal material become zero, said driving unit, during the erasing of image data, performing a single batch selection by applying a gate signal to at least two or all of the plurality scanning lines, and simultaneously applying each of the different voltages having different voltage levels to the pixel electrodes corresponding to at least two or all of the plurality of scanning lines in a period of the single batch selection for erasing the image data and equalizing the voltages being applied to the liquid crystal material between the common electrode and each of the plurality of pixel electrodes, the batch selection being performed periodically, and the different voltages being applied separately during the single batch selection, wherein a first of the different voltages has a value not smaller than a maximum value of the voltage applied in writing the image data and a different polarity than the voltage applied in writing the image data, and the last of the different voltages has a same value as a voltage on the common electrode;

a light source for emitting white color light; and color filters of a plurality of colors, wherein color display is provided by selectively transmitting the emitted light from said light source by using said color filters, the plurality of the scanning lines for erasing data are simultaneously selected during the erasure of the data, said light source, within each frame, is turned on after the first voltage application and from substantially at an end of the second voltage application to the liquid crystal material corresponding to each of the plurality of pixel electrodes during the writing of the image date, and turned off at a start of the erasing of the image data, and wherein further during the erasure of the data image, a time of application of the last of the different voltages is set to be equal to or less than one tenth of a time of application of the first of the different voltages.

4. A liquid crystal display device comprising:

a liquid crystal panel including a common electrode, a plurality of pixel electrodes distributed along each of a plurality of scanning lines, a liquid crystal material having spontaneous polarization sealed between the common electrode and the plurality of pixel electrodes, and switching elements provided for the plurality of pixel electrodes, respectively, for controlling voltage application to the liquid crystal material;

a driving unit for writing image data by applying a voltage in a first voltage application to the liquid crystal material corresponding to each of the plurality of pixel electrodes and a second voltage application to the liquid crystal material corresponding to each of the plurality of pixel electrodes, in each frame, and erasing the image data on said liquid crystal panel by applying a plurality of different voltages having different voltage levels discretely to the liquid crystal material corresponding to each of the plurality of pixel electrodes to make a voltage value of the liquid crystal material become zero, said driving unit, during the erasing of image data, performing a single batch selection by applying a gate signal to at least two or all of the plurality scanning lines, and simultaneously applying the different voltages having different voltage levels to the pixel electrodes corresponding to at least two or all of the plurality of scanning lines in a period of the single batch selection for erasing the image data and equalizing the voltages being applied to the liquid crystal material between the common electrode and each of the plurality of pixel electrodes, the batch selection being performed periodically, and the different voltages being applied separately during the single batch selection, wherein a first of the different voltages having a value not smaller than a maximum value of the voltage applied in writing the image data and a different polarity than the voltage applied in writing the image data, and the last of the different voltages having a same value as a voltage on the common electrode; and a light source for emitting light of a plurality of different colors, wherein color display is provided by performing time-division switching of the colors of light emitted by said light source in synchronism with on/off driving of the switching elements, the plurality of the scanning lines for erasing data are simultaneously selected during the erasure of the data, said light source, within each frame, is turned on after the first voltage application for each of the plurality of different colors and from substantially at an end of the second voltage application to the liquid crystal material corresponding to each of the plurality of pixel electrodes during the writing of the image date, and turned off at a start of the erasing of the image data, and wherein further during the erasure of the data image, a time of application of the last of the different voltages is set to be equal to or less than one tenth of a time of application of the first of the different voltages.

5. A method for driving a liquid crystal display device having a common electrode, a plurality of pixel electrodes distributed along each of a plurality of scanning lines, a liquid crystal material having spontaneous polarization sealed between the common electrode and the plurality of pixel electrodes, switching elements provided for the plurality of pixel electrodes, respectively, for controlling voltage application to the liquid crystal material, and a back-light for generating light, said method comprising the steps of:

writing image data by applying a voltage in a first voltage application to the liquid crystal material corresponding to each of the plurality of pixel electrodes and a second voltage application to the liquid crystal material corresponding to each of the plurality of pixel electrodes, in each frame; and erasing the image data by applying two different voltages having different voltage levels discretely to the liquid crystal material corresponding to each of the plurality of pixel electrodes to make a voltage value of the liquid crystal material become zero, the two different voltages including a first voltage, which has a value not smaller, and with a different polarity, than a maximum voltage applied to the liquid crystal material in writing the image data, and a second voltage which has a same value as a voltage on the common electrode;

wherein during the erasure of image data, a single batch selection is performed by applying a gate signal to at least two or all of the plurality of scanning lines, and each of the different voltages is applied simultaneously to the pixel electrodes corresponding to the at least two or all of the plurality of scanning lines in a period of the single batch selection for erasing the image data and equalizing the voltages being applied to the liquid crystal material between the common electrode and each of the plurality of pixel electrodes, the batch selection being performed periodically, the different voltages being applied separately during the single batch selection, the plurality of the scanning lines for erasing data are selected simultaneously during the erasure of the data, the back-light, within each frame, is turned on after the first voltage application and from substantially at an end of the second voltage application to the liquid crystal material corresponding to each of the plurality of pixel electrodes during the writing of the image date, and turned off at a start of the erasing of the image data, and wherein further during the erasure of the data image, a time of application of the last of the different voltages is set to be equal to or less than one tenth of a time of application of the first of the different voltages.

6. The driving method of a liquid crystal display device of claim 1, wherein a gate signal is applied twice in each frame to each of the scanning lines corresponding to the plurality of pixel electrodes during the writing of the image data.

7. The driving method of a liquid crystal display device of claim 3, wherein a gate signal is applied twice in each frame to each of the scanning lines corresponding to the plurality of pixel electrodes during the writing of the image data.

8. The driving method of a liquid crystal display device of claim 4, wherein a gate signal is applied twice in each frame to each of the scanning lines corresponding to the plurality of pixel electrodes during the writing of the image data.

9. The driving method of a liquid crystal display device of claim 5, wherein a gate signal is applied twice in each frame to each of the scanning lines corresponding to the plurality of pixel electrodes during the writing of the image data.

* * * * *